US009837693B2

(12) United States Patent
Rogers et al.

(10) Patent No.: US 9,837,693 B2
(45) Date of Patent: Dec. 5, 2017

(54) COAXIAL POLARIZER

(71) Applicant: Honeywell International Inc., Morristown, NJ (US)

(72) Inventors: Shawn D. Rogers, Johns Creek, GA (US); Craig A. Bunn, Cumming, GA (US); Gary L. Mitchum, Dunwoody, GA (US); John C. Hoover, Fernandina Beach, FL (US)

(73) Assignee: Honeywell International Inc., Morris Plains, NJ (US)

( * ) Notice: Subject to any disclaimer, the term of this patent is extended or adjusted under 35 U.S.C. 154(b) by 670 days.

(21) Appl. No.: 14/039,872

(22) Filed: Sep. 27, 2013

(65) Prior Publication Data

US 2015/0091671 A1 Apr. 2, 2015

(51) Int. Cl.

| | |
|---|---|
| ***H01P 1/17*** | (2006.01) |
| ***H01P 1/165*** | (2006.01) |
| ***H01P 11/00*** | (2006.01) |

(52) U.S. Cl.

CPC ..... *H01P 1/172* (2013.01); *H01P 1/165* (2013.01); *H01P 11/00* (2013.01); *Y10T 29/49016* (2015.01)

(58) Field of Classification Search

CPC ..... H01P 1/165; H01P 11/00; H01P 1/172; H01P 1/17; Y10T 29/49016

USPC ..... 333/21 A, 157, 160

See application file for complete search history.

(56) References Cited

U.S. PATENT DOCUMENTS

| | | | |
|---|---|---|---|
| 2,694,778 | A | 11/1954 | Rowland et al. |
| 6,323,819 | B1 | 11/2001 | Ergene |
| 6,417,742 | B1 | 7/2002 | Enokuma |
| 6,664,866 | B2 | 12/2003 | Yoneda et al. |
| 7,656,246 | B2 | 2/2010 | Mahon et al. |
| 8,013,687 | B2 | 9/2011 | Espino et al. |
| 8,248,178 | B2 | 8/2012 | Lange |
| 2009/0243761 | A1 | 10/2009 | Mahon et al. |
| 2009/0251233 | A1 | 10/2009 | Mahon et al. |
| 2010/0127801 | A1 | 5/2010 | Adkins |

(Continued)

OTHER PUBLICATIONS

European Patent Office, "Extended European Search Report from EP Application No. 14177545.2 dated Mar. 6, 2015", "from Foreign Counterpart of U.S. Appl. No. 14/039,872", Mar. 6, 2015, pp. 19, Published in: EP.

*Primary Examiner* — Benny Lee
*Assistant Examiner* — Jorge Salazar, Jr.
(74) *Attorney, Agent, or Firm* — Fogg & Powers LLC

(57) ABSTRACT

A coaxial polarizer is provided. The coaxial polarizer includes an outer-conductive tube, an inner-conductive tube positioned within and axially aligned with the outer-conductive tube, and two dielectric bars each having a flat-first surface. The inner-conductive tube has two shallow-cavities on opposing portions of an outer surface of the inner-conductive tube. The shallow-cavities each have at least one planar area having a cavity length parallel to a Z axis and a cavity width, including a minimum width, perpendicular to the Z axis and to a radial direction of the inner-conductive tube. The flat-first surface has a dielectric length and width that are parallel and perpendicular to the Z axis, respectively. The dielectric length and dielectric width are less than the cavity length and the minimum width, respectively. The two flat-first surfaces of the respective two dielectric bars contact at least a portion of the respective two planar areas of the two shallow-cavities.

26 Claims, 22 Drawing Sheets

(56) References Cited

U.S. PATENT DOCUMENTS

| | | | |
|---|---|---|---|
| 2012/0319804 | A1 | 12/2012 | Mahon et al. |
| 2013/0050040 | A1 | 2/2013 | Libonati et al. |
| 2015/0214616 | A1 | 7/2015 | Rogers et al. |

COAXIAL POLARIZER

The U.S. Government may have rights in the invention under Government Contract No. H94003-04-D-0005/7600009933 awarded by the U.S. Government to Northrop Grumman and under Government Contract No. F33657-02-D-0009/4743848 awarded by the U.S. Government to Lockheed Martin.

BACKGROUND

Circular polarization is converted from linear polarization by splitting the incoming wave into two orthogonal wave vectors that are approximately equal in amplitude and 90 degrees apart in phase. The device that converts polarization from one state to another is often called a polarizer. Such a device may take the form of a waveguide component, a flat layered material placed above an antenna aperture, or as a multiport microwave device.

Some waveguide polarizers are coaxial polarizers. Coaxial polarizers often have dielectric pieces attached to the outer surface of a conductive inner tube of the coaxial waveguide. These dielectric pieces are responsible for creating the 90 degree phase difference in two orthogonal output modes of equal amplitude which leads to circular polarization. In prior art coaxial polarizers, the outer surface of a conductive inner tube of the coaxial waveguide has protrusions and the dielectric pieces have mating indents, by which the dielectric pieces are attached to the protrusions of the conductive inner tube. The conductive inner tubes with protrusions require complex machining processes. Likewise, the dielectric pieces that are mated to the protrusions require complex machining processes.

SUMMARY

The present application relates to a coaxial polarizer. The coaxial polarizer includes an outer-conductive tube, an inner-conductive tube positioned within the outer-conductive tube and axially aligned with the outer-conductive tube, and two dielectric bars each having a flat-first surface. The inner-conductive tube has two shallow-cavities on opposing portions of an outer surface of the inner-conductive tube. The shallow-cavities each have at least one planar area. The at least one planar area has a cavity length parallel to a Z axis and has at least one cavity width that is perpendicular to the Z axis and perpendicular to a radial direction of the inner-conductive tube. The at least one cavity width includes a minimum width. The flat-first surface has a dielectric length parallel to the Z axis and a dielectric width perpendicular to the Z axis. The dielectric length is less than the cavity length and the dielectric width is less than the minimum width. Cross-sections of each of the two dielectric bars taken perpendicular to the Z axis have four respective surfaces in a rectangular shape. The two flat-first surfaces of the respective two dielectric bars contact at least a portion of the respective two planar areas of the two shallow-cavities.

The details of various embodiments of the claimed invention are set forth in the accompanying drawings and the description below. Other features and advantages will become apparent from the description, the drawings, and the claims.

DRAWINGS

FIG. 12B is an enlarged view of the edge shown in FIG. 12A;

Like reference numbers and designations in the various drawings indicate like elements.

DETAILED DESCRIPTION

The coaxial polarizers described herein are single coaxial waveguide devices with one physical input port and one physical output port. The dielectric pieces are attached to the center conductor of the coaxial waveguide with ease. The machining for the center conductor in the coaxial polarizers described herein is less complex than the machining required for prior art coaxial polarizers. The dielectric pieces attached to the center conductor of the coaxial waveguide create the 90 degree phase difference in two orthogonal output modes of equal amplitude which leads to circular polarization. The dielectric pieces described herein are simpler in shape and therefore simpler to fabricate than the dielectric pieces in prior art coaxial polarizers. Likewise, the method for attaching the dielectric pieces to the center conductor is a convenient and relatively low-cost method compared to prior art methods of making coaxial polarizers. The geometry of the center conductive tube and the specific shape of the dielectric pieces are optimized and the performance, including the input return loss, of the coaxial polarizers is improved by adding a metal ring on the outer surface of the center conductor. When the diameter, length, and distance of the ring from the dielectric bars are optimized in concert with the other variables, excellent return loss and axial ratio are achieved. The steps in embodiments of the dielectric bars described herein and the impedance matching ring result in a coaxial polarizer with reduced length. The compact size of the coaxial polarizer allows antenna feeds to be small enough to meet stringent size constraints especially since other components are also required such as transitions, radiators, and filters. The configurations of dielectric bars and inner conductive tubes described herein permits a flat-first surface of the dielectric to be parallel to and attached to a planar area in a shallow-cavity on the surface of the inner conductive tube.

Figure 1:
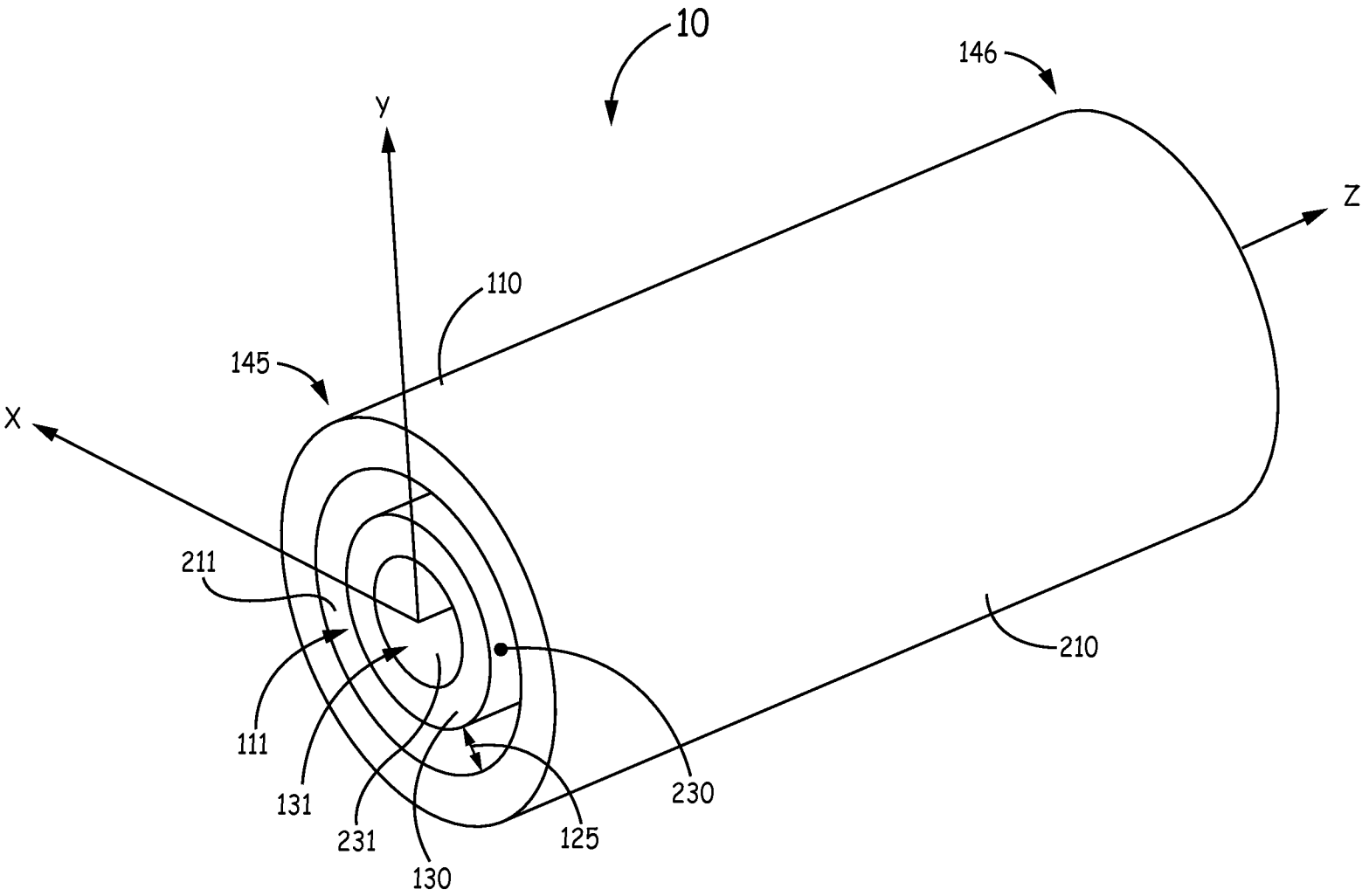
FIG. 1 is an oblique view of one embodiment of a coaxial polarizer.
Figure 2A:
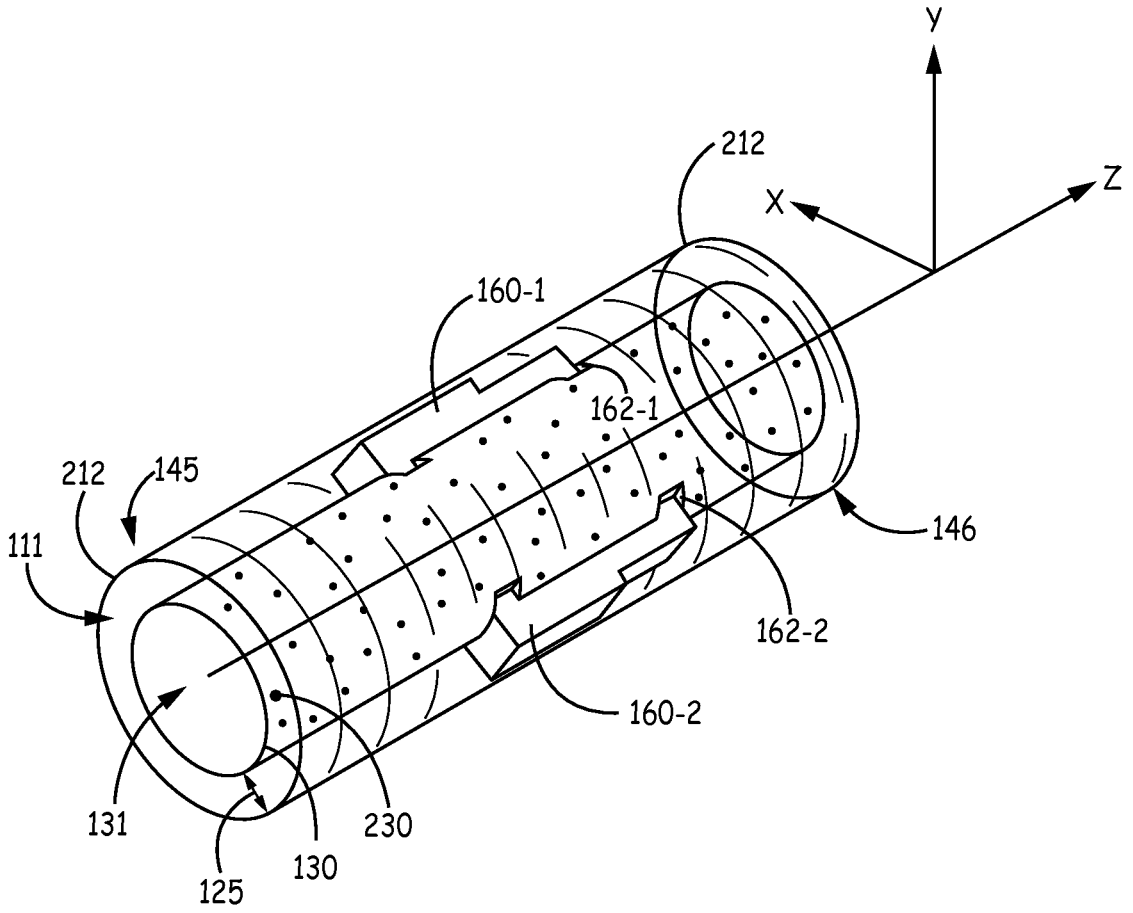
FIG. 2A is an oblique view of one embodiment of the coaxial polarizer of FIG. 1 with attached first dielectric and second dielectric.
Figure 2B:
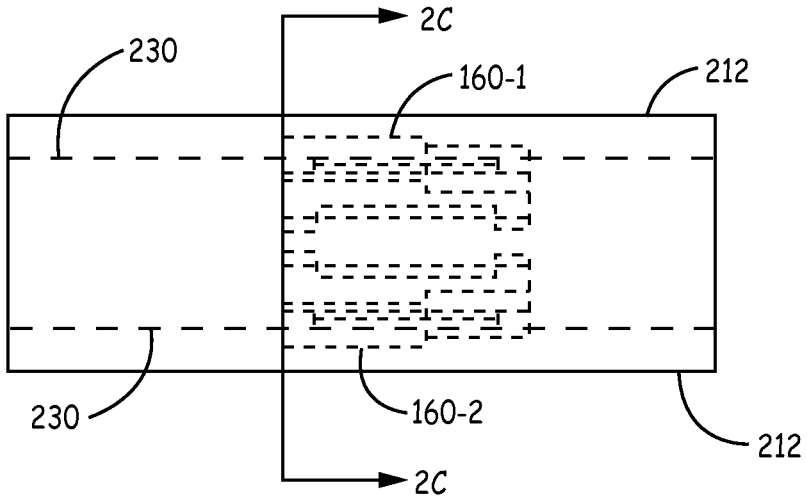
FIG. 2B is a top view of the coaxial polarizer of FIG. 2A.
Figure 2C:
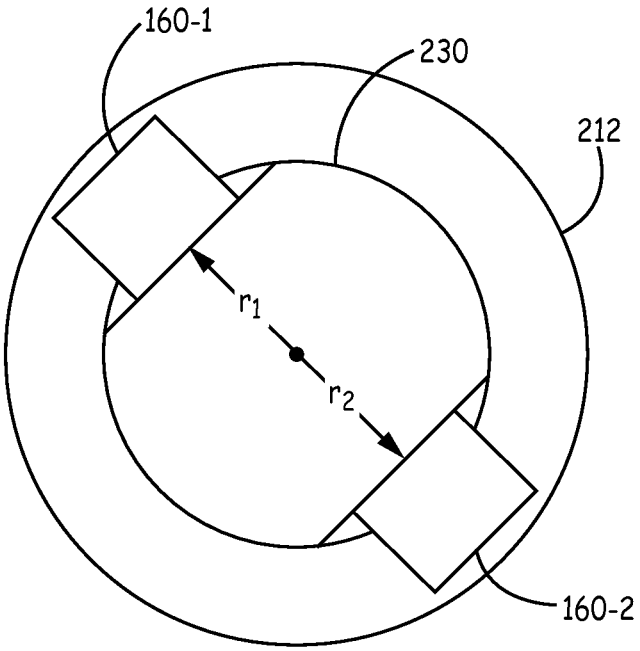
FIG. 2C is a cross section view of the coaxial polarizer of FIG. 2A.
Figure 3:
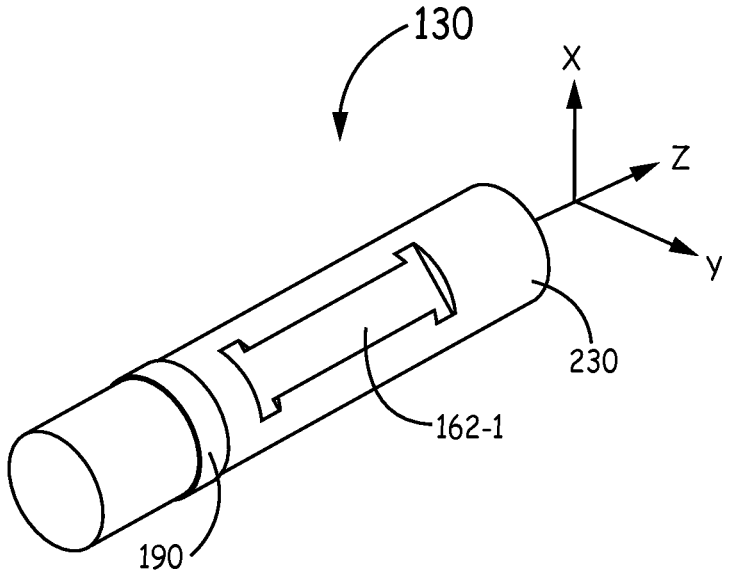
FIG. 3 is an oblique view of one embodiment of the inner-conductive tube of the coaxial polarizer of FIG. 1.
Figure 4:
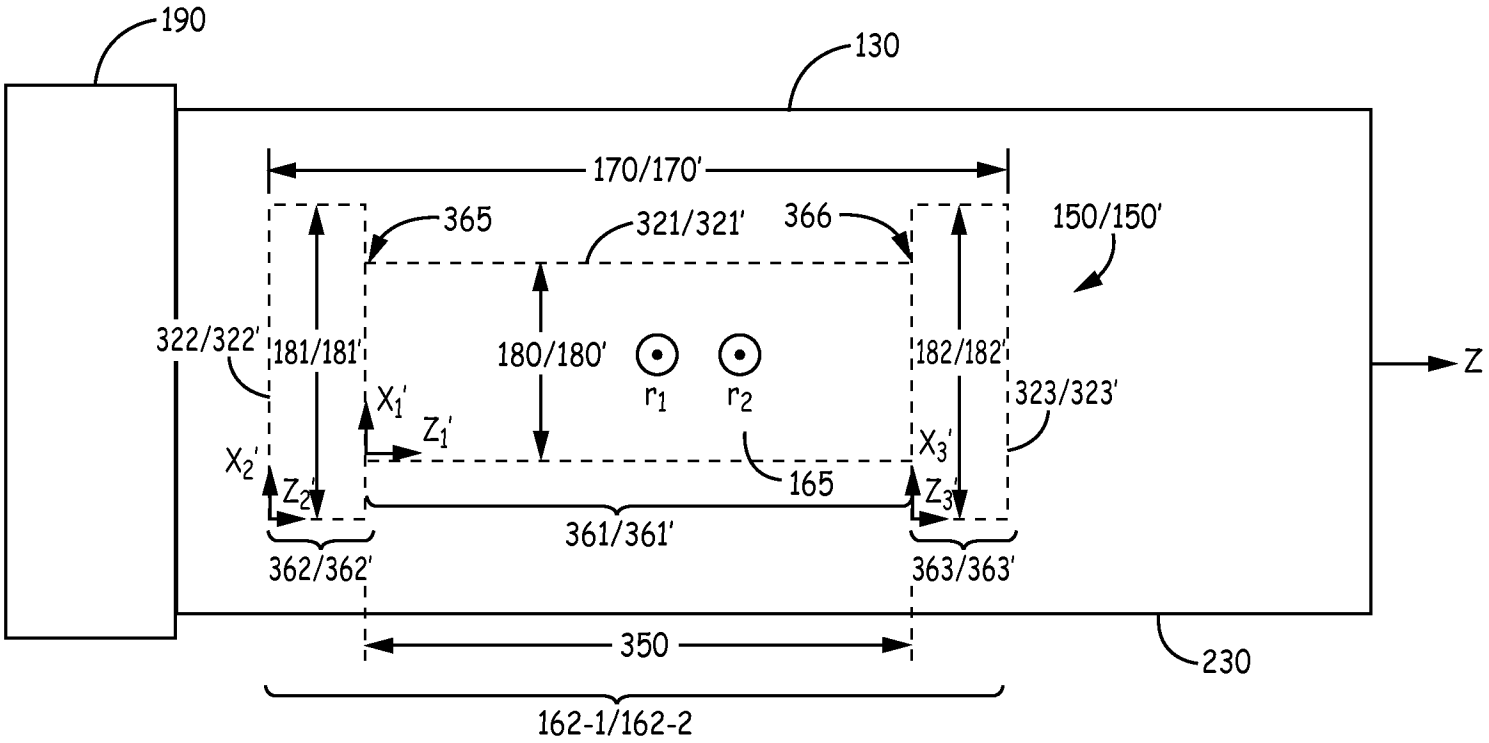
FIG. 4 is an expanded view of a shallow-cavity on the inner-conductive tube of FIG. 3.

FIG. 1 is an oblique view of one embodiment of a coaxial polarizer 10. The coaxial polarizer 10 has a physical input port at an input end 145 and one physical output port at an output end 146. FIG. 2A is an oblique view of one embodiment of the coaxial polarizer 10 of FIG. 1 with attached first dielectric 160-1 and second dielectric 160-2. FIG. 2B is a top view of the coaxial polarizer 10 of FIG. 2A. FIG. 2C is a cross section view of the coaxial polarizer 10 of FIG. 2A. FIG. 3 is an oblique view of one embodiment of the inner-conductive tube 130 of the coaxial polarizer 10 of FIG. 1. FIG. 4 is an expanded view of a shallow-cavity 162 on the inner-conductive tube 130 of FIG. 3. FIGS. 5A-5D are various views of the first dielectric 160-1 of FIGS. 2A-2C. The second dielectric 160-2 of FIGS. 2A-2C has the same shape and structure as the first dielectric 160-1. The first dielectric 160-1 and second dielectric 160-2 are also referred to herein as "dielectric bar 160-1" and "dielectric bar 160-2".

The coaxial polarizer 10 includes an outer-conductive tube 110 and an inner-conductive tube 130 positioned within the outer-conductive tube 110. The inner-conductive tube 130 is axially aligned with the outer-conductive tube 110 using alignment spacers or features of the system in which the coaxial polarizer 10 is positioned. The inner-conductive tube 130 has a hollow core 131 that is bounded by the inner surface 231 of the inner-conductive tube 130. The input end 145 of the coaxial polarizer 10 is spanned by the X-Y vectors shown in FIG. 1.

The inner-conductive tube 130 and the outer-conductive tube 110 are concentrically aligned to each other. The outer surface 230 of the inner-conductive tube 130 is radially offset from the inner surface 211 of the outer-conductive tube 110 by a distance indicted by a double-headed arrow labeled 125. The region between the outer surface 230 of the inner-conductive tube 130 and the inner surface 211 of the outer-conductive tube 110, which is represented generally at 111, supports modes propagating in the Z direction from the input port at the input end 145 to the output port at the output end 146 as known to one skilled in the art. The inner-conductive tube 130 of the coaxial polarizer 10 is hollow to support a second frequency band interior to the coaxial polarizer 10. The hollow core 131 of the inner-conductive tube 130 supports modes propagating in the Z direction from the input port at the input end 145 to the output port at the output end 146 within the hollow core 131. In one implementation of this embodiment, the second frequency band is not required and the inner-conductive tube 130 is a solid metal cylinder.

FIGS. 2A-2C shows an outline represented generally at 212 of the inner surface 211 (FIG. 1) of the outer-conductive tube 110. The outer surface 230 of inner-conductive tube 130 is visible in FIGS. 2A-2C through the outline 212 of the inner surface 211 (FIG. 1) of the outer-conductive tube 110.

The outer surface 230 of the inner-conductive tube 130 of the coaxial polarizer 10 of FIG. 1 has been formed with shallow-cavities 162-1 and 162-2 (FIGS. 2-4). The shallow-cavity 162-1 is also referred to herein as "first shallow-cavity 162-1". The shallow-cavity 162-2 is also referred to herein as "second shallow-cavity 162-2". The second shallow-cavity 162-2 is on a section of the outer surface 230 of the inner-conductive tube 130 that opposes the first shallow-cavity 162-1. The shape of the shallow-cavities 162-1 and 162-2 is referred to herein as an I-shape.

As shown in FIGS. 2A-2C, two dielectric bars 160-1 and 160-2 are positioned within the two opposing shallow-cavities 162-1 and 162-2. The dielectric bar 160-1 is also referred to herein as "first dielectric bar 160-1". The dielectric bar 160-2 is also referred to herein as "second dielectric bar 160-2". The first shallow-cavity 162-1 and the second shallow-cavity 162-2 serve to align the respective first dielectric bar 160-1 and second dielectric bar 160-2 in two directions. The 2 dimensional alignment, which is automatically provided by the first shallow-cavity 162-1 and the second shallow-cavity 162-2, eliminates the need for an external alignment fixture (as required in prior art systems) during assembly of the coaxial polarizer 10.

A first shallow-cavity 162-1 is shown in FIGS. 3 and 4. As shown in FIG. 4, the first shallow-cavity 162-1 has a cavity length 170 parallel to a Z axis and three cavity widths 180, 181, and 182 that are perpendicular to the Z axis and perpendicular to a first radial direction $r_1$ (FIG. 2) of the inner-conductive tube 130. The radial direction is the direction in three dimensions (X, Y, and Z) of a radius vector. The length of the radius vector is a radius of curvature. The cavity width 180 is a minimum width 180 (i.e., a minimum-cavity width 180).

As shown in FIG. 4, the first-full-planar area 150 of the first shallow-cavity 162-1 includes a first planar area 321 in a first section 361 of the first shallow-cavity 162-1. The first planar area 321 in the first section 361 has a first-cavity width 180 equal to the minimum width 180. The planar area 321 of the first shallow-cavity 162-1 is perpendicular to the first radial direction $r_1$ (FIG. 2) of the inner-conductive tube 130 and spans a plane $X_1'$-$Z_1'$ in the first section 361. The first-cavity width 180 of the first planar area 321 is perpendicular to the $Z_1'$ axis and perpendicular to a first radial direction $r_1$ (FIG. 2) of the inner-conductive tube 130. A first-cavity length 350 of the first planar area 321 in the first section 361 is parallel to the $Z_1'$ axis. The first planar area 321 in the first section 361 is also referred to herein as a "first-section-planar area 321".

The first-full-planar area 150 of the first shallow-cavity 162-1 also includes a second planar area 322 in a second section 362 of the first shallow-cavity 162-1. The second planar area 322 in the second section 362 is adjoined to and parallel to the first planar area 321 in the first section 361. The second planar area 322 in the second section 362 is perpendicular to the first radial direction $r_1$ (FIG. 2) of the inner-conductive tube 130 and spans a plane $X_2'$-$Z_2'$. The plane $X_2'$-$Z_2'$ is parallel to and overlaps with the plane $X_1'$-$Z_1'$. The second section 362 has a second-cavity width 181 that is perpendicular to the $Z_2'$ axis and perpendicular to a first radial direction $r_1$ (FIG. 2) of the inner-conductive tube 130. The second-cavity width 181 is larger than the minimum width 180. A second-cavity length of the second planar area 322 in the second section 362 is parallel to the $Z_2'$ axis. The second planar area 322 in the second section 362 is also referred to herein as a "second-section-planar area 322".

The first-full-planar area 150 of the first shallow-cavity 162-1 also includes a third planar area 323 in a third section 363 of the first shallow-cavity 162-1. The third planar area 323 in the third section 363 is adjoined to and parallel to the first planar area 321 in the first section 361. The third planar area 323 in the third section 363 is perpendicular to the first radial direction $r_1$ (FIG. 2) of the inner-conductive tube 130 and spans a plane $X_3'$-$Z_3'$. The plane $X_3'$-$Z_3'$ is parallel to and overlaps with the plane $X_1'$-$Z_1'$. The third section 363 has a third-cavity width 182 that is perpendicular to the $Z_3'$ axis and perpendicular to a first radial direction $r_1$ (FIG. 2) of the inner-conductive tube 130. The third-cavity width 182 is larger than the minimum width 180. The third-cavity width 182 equals the second-cavity width 181. A third-cavity length of the third planar area 323 is parallel to the $Z_3'$ axis. The third planar area 323 in the third section 363 is also referred to herein as a "third-section-planar area 323". The first-cavity length 350 of the first planar area 321, the second-cavity length of the second planar area 322, and the third-cavity length of the third planar area 323 are equal to the cavity length 170 of the first shallow-cavity 162-1.

The second shallow-cavity 162-2 is similar to the first shallow-cavity 162-1 and is also described with reference to FIG. 4. The numerical labels for the features in the second shallow-cavity 162-2 are indicated with primes.

The second-full-planar area 150' of the second shallow-cavity 162-2 includes a fourth planar area 321' in a fourth section 361' of the second shallow-cavity 162-2. The fourth planar area 321' in the fourth section 361' has a fourth-cavity width 180' equal to a second minimum width 180'. The fourth planar area 321' of the second shallow-cavity 162-2 is perpendicular to a second radial direction $r_2$ (FIG. 2) of the inner-conductive tube 130. As is understandable, the second radial direction $r_2$ and the first radial direction $r_1$ have equal length but opposite directions, so a plane perpendicular to one of the first or second radial direction is also perpendicular to the other. The fourth planar area 321' in the fourth section 361' is also referred to herein as a "fourth-section-planar area 321'".

The second-full-planar area 150' of the second shallow-cavity 162-2 also includes a fifth planar area 322' in a fifth section 362' of the second shallow-cavity 162-2. The fifth planar area 322' in the fifth section 362' is adjoined to and parallel to the fourth planar area 321' in the fourth section 361'. The fifth planar area 322' in the fifth section 362' is perpendicular to the second radial direction $r_2$ (FIG. 2) of the inner-conductive tube 130. The fifth section 362' has a fifth-cavity width 181' that is perpendicular to the Z axis and perpendicular to the second radial direction $r_2$ (FIG. 2) of the inner-conductive tube 130. The fifth-cavity width 181' is larger than the second-minimum width 180'. The fifth planar area 322' in the fifth section 362' is also referred to herein as a "fifth-section-planar area 322'".

The second-full-planar area 150' of the second shallow-cavity 162-2 also includes a sixth planar area 323' in a sixth section 363' of the second shallow-cavity 162-2. The sixth planar area 323' in the sixth section 363' is adjoined to and parallel to the fourth planar area 321' in the fourth section 361'. The sixth planar area 323' in the sixth section 363' is perpendicular to second radial direction $r_2$ (FIG. 2) of the inner-conductive tube 130. The sixth section 363' has a sixth-cavity width 182' that is perpendicular to the Z axis and perpendicular to the second radial direction $r_2$ (FIG. 2) of the inner-conductive tube 130. The sixth-cavity width 182' is larger than the second-minimum width 180'. The sixth-cavity width 182' equals the fifth-cavity width 181'. The sixth planar area 323' in the sixth section 363' is also referred to herein as a "sixth-section-planar area 323'".

In one implementation of this embodiment, the first shallow-cavity 162-1 and the second shallow-cavity 162-2 have the same dimensions. In one implementation of this embodiment, the cavity length 170 of the first shallow-cavity 162-1 equals the cavity length 170' of the second shallow-cavity 162-2. In another implementation of this embodiment, the cavity width 180 of the first shallow-cavity 162-1 equals the cavity width 180' of the second shallow-cavity 162-2. In yet another implementation of this embodiment, the first shallow-cavity 162-1 and the second shallow-cavity 162-2 have different shapes. In that case, second shallow-cavity 162-2 is another one of the shapes described herein. In any case, the shallow-cavities 162-1 and 162-2 each have at least one planar area that is perpendicular to a radial direction of the inner-conductive tube 130.

Figure 5B:
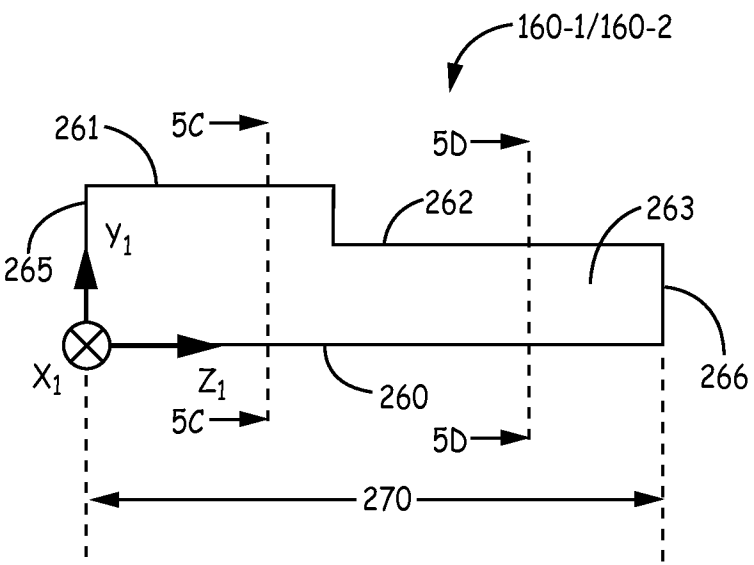
FIGS. 5A-5D are various views of the first dielectric of FIG. 2.
Figure 5A:
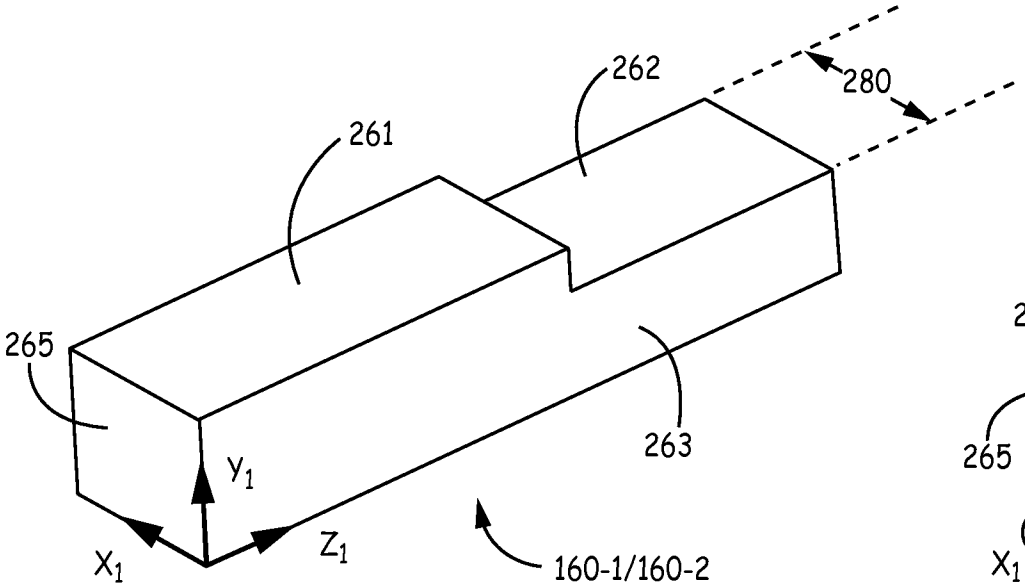
Figure 5C:
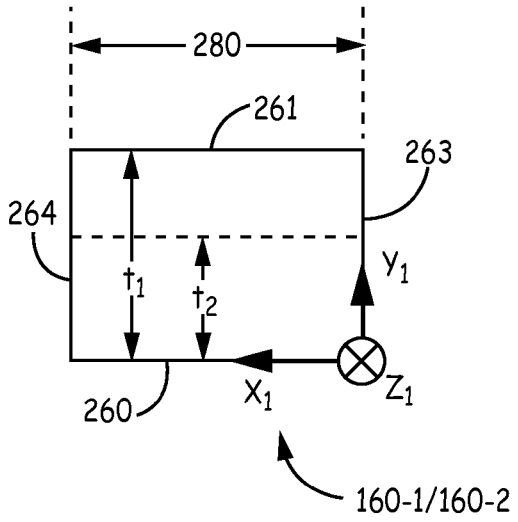
Figure 5D:
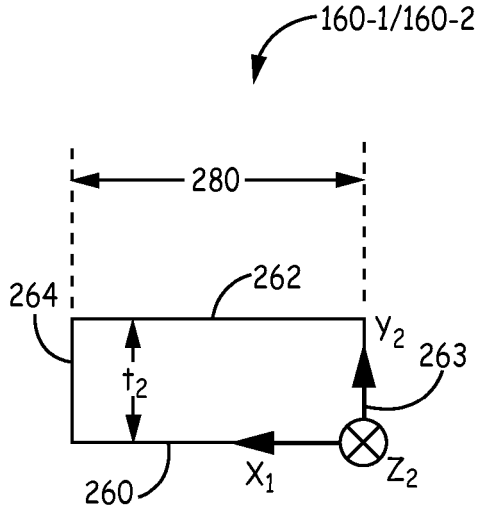

FIG. 5A shows an oblique view of the dielectric bars 160-1 and 160-2. FIG. 5B shows a side view of the dielectric bars 160-1 and 160-2. FIG. 5C shows a first cross-sectional view of the dielectric bars 160-1 and 160-2. The plane upon which the cross-section view of FIG. 5C is taken is indicated by section line 5C-5C in FIG. 5B. FIG. 5D shows a second cross-sectional view of the dielectric bars 160-1 and 160-2. The plane upon which the cross-section view of FIG. 5D is taken is indicated by section line 5D-5D in FIG. 5B. A surface 260 shown in each of the dielectric bars 160-1 and 160-2 is the surface that is attached to the shallow-cavity 162-1 and 162-2, respectively. The surface 260 is referred to herein as the "flat-first surface 260".

As shown in FIG. 5B, the surface 260 has a dielectric length 270 parallel to the $Z_1$ axis. The dielectric length 270 (FIG. 5B) is less than the cavity length 170 (FIG. 4). As shown in FIGS. 5A, 5C, and 5D, the surface 260 has a dielectric width 280 parallel to the $X_1$ axis. The dielectric width 280 is less than the minimum width 180 (FIG. 4).

The dielectric bars 160-1 and 160-2 each have the shape of two stepped rectangular prisms. Thus, a cross-sectional view of each of the two dielectric bars 160-1 and 160-2 taken perpendicular to the Z axis has four respective surfaces in a rectangular shape. The cross-sectional view of FIG. 5C shows the first surface 260 is: parallel to a second surface 261; perpendicular to a third surface 263; and perpendicular to a fourth surface 264. The first surface 260 is offset from the second surface 261 a thickness $t_1$. Each of the surfaces 260, 261, 263, and 264 is flat. Thus, the first-cross-section shown in FIG. 5C has a first-rectangular shape including a width 280 that is less than the minimum width 180.

A flat surface, as used herein, is not necessarily flat to known optical flatness (e.g., flatness is not based on wavelengths). As defined herein a surface is flat if there are small protrusions on the order of 10s of microns. As defined herein, surfaces are parallel to each other even if they subtend planes that intersect at an angle within a few degrees (e.g., parallelism is not based on wavelengths).

The cross-sectional view of FIG. 5D shows the first surface 260 is: parallel to a fifth surface 262; perpendicular to the third surface 263; and perpendicular to the fourth surface 264. The first surface 260 is offset from the fifth surface 262 the thickness $t_2$. The thickness $t_2$ is less than the thickness $t_1$. Thus, the second-cross-section in FIG. 5D has a second-rectangular shape including the width 280 that is less than the minimum width 180.

In one implementation of this embodiment, the first dielectric 160-1 and the second dielectric 160-2 have the same shape. In another implementation of this embodiment, the first dielectric 160-1 and the second dielectric 160-2 have different shapes. In that case, second dielectric 160-2 has the shape of any of the other dielectric shapes described herein. In any case, the first dielectric 160-1 and second dielectric 160-2 each have a flat-first surface 260 that is rectangular in shape. The first dielectric 160-1 and the second dielectric 160-2 are placed into the respective minimally oversized shallow-cavities 162-1 and 162-2. As shown in FIG. 2, the two flat-first surfaces 260-1 and 260-2 of the respective two dielectric bars 160-1 and 160-2 contact at least a portion of the respective planar areas of the two shallow-cavities 162-1 and 162-2.

In one implementation of this embodiment, the shallow-cavities 162-1 and 162-2 are machined on the outer surface 230 of the inner-conductive tube 130, and the first dielectric 160-1 and the second dielectric 160-2 are held in place within the shallow-cavities 162-1 and 162-2 with industrial adhesive. When the first dielectric 160-1 and the second dielectric 160-2 are attached to the inner-conductive tube 130 and enclosed in the outer-conductive tube 110, they do not touch the inner surface 211 (FIG. 1) of the outer-conductive tube 110.

The capital letter I-shape of the shallow-cavities 162-1 and 162-2 shown in FIGS. 2-4 prevents interior radii in the corners that would interfere with the respective exterior corners of the dielectric bars 160-1 and 160-2. To accomplish this during machining, the end-mill bit is allowed to "run off" of the part to create the top and bottom portions of the capital letter I. Four distinct shallow sides, which do not extend beyond the original diameter of the inner-conductive tube, remain for the purpose of locating the dielectric bars 160-1 and 160-2 in the respective shallow-cavities 162-1 and 162-2 during assembly of the coaxial polarizer 10. However, due to part tolerances, the shallow-cavities 162-1 and 162-2 are intentionally designed to be oversized (i.e., larger than the dielectric bars 160-1 and 160-2 to be attached). In this way, the shallow-cavities 162-1 and 162-2 are not designed to captivate the dielectric bars 160-1 and 160-2 in a snap-fit. Instead shallow-cavities 162-1 and 162-2 are guides to align the dielectric bars 160-1 and 160-2 in two directions (the X and Z directions) without an external alignment fixture. The dielectric bars 160-1 and 160-2 are glued into the shallow-cavities 162-1 and 162-2 during assembly. It is important that the wall thickness of the hollow inner-conductive tube 130 is thick enough so the bottom floor (e.g., the planar area including sections 361-363) of the shallow-cavities 162-1 and 162-2 does not penetrate through to the interior surface of the circular waveguide 131.

Figure 6A:
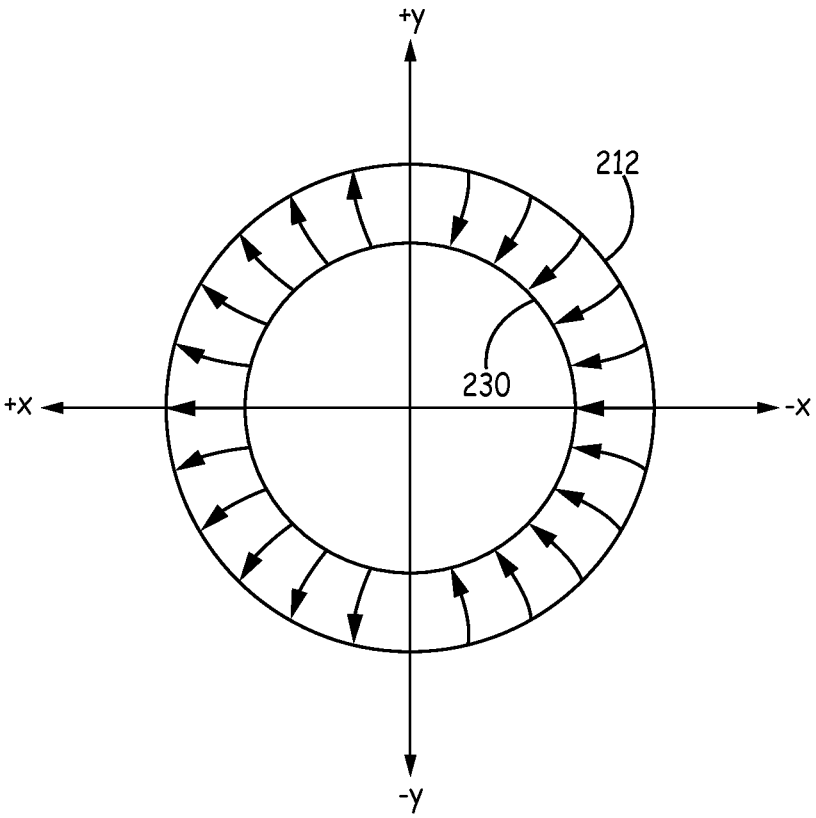
FIG. 6A shows a $TE_{11}$ mode oriented parallel to the X axis.
Figure 6B:
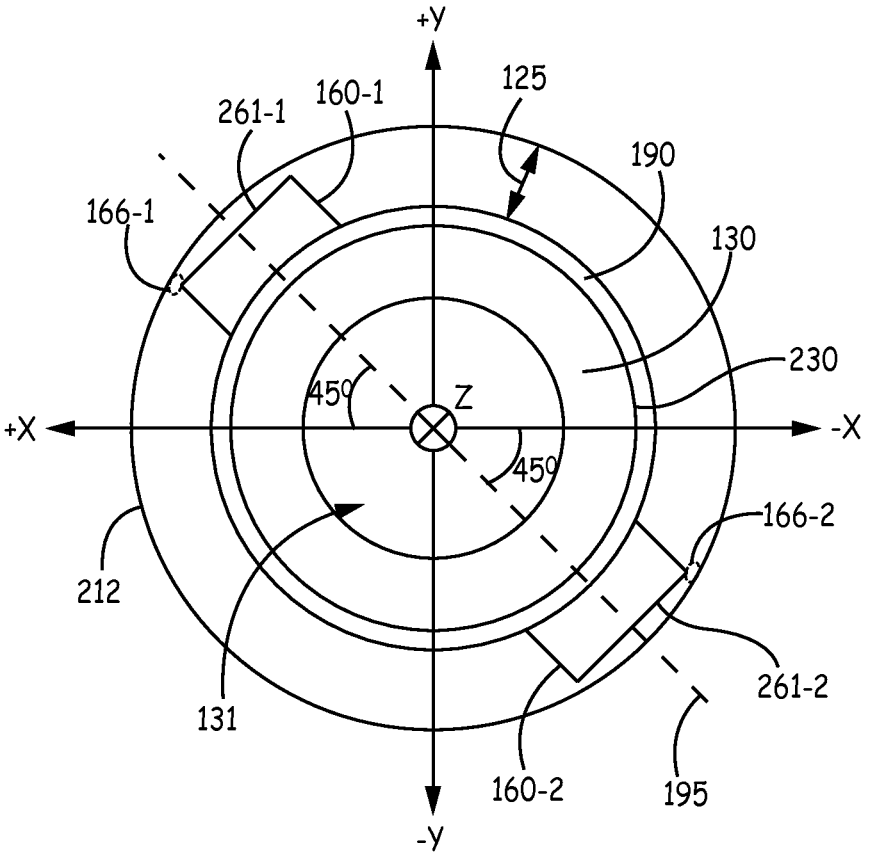
FIG. 6B is an end-view from the input end of a coaxial polarizer with an inner-conductive tube on which dielectric bars are positioned for right-hand-circular polarization when excited by the $TE_{11}$ mode shown in FIG. 6A.
Figure 6C:
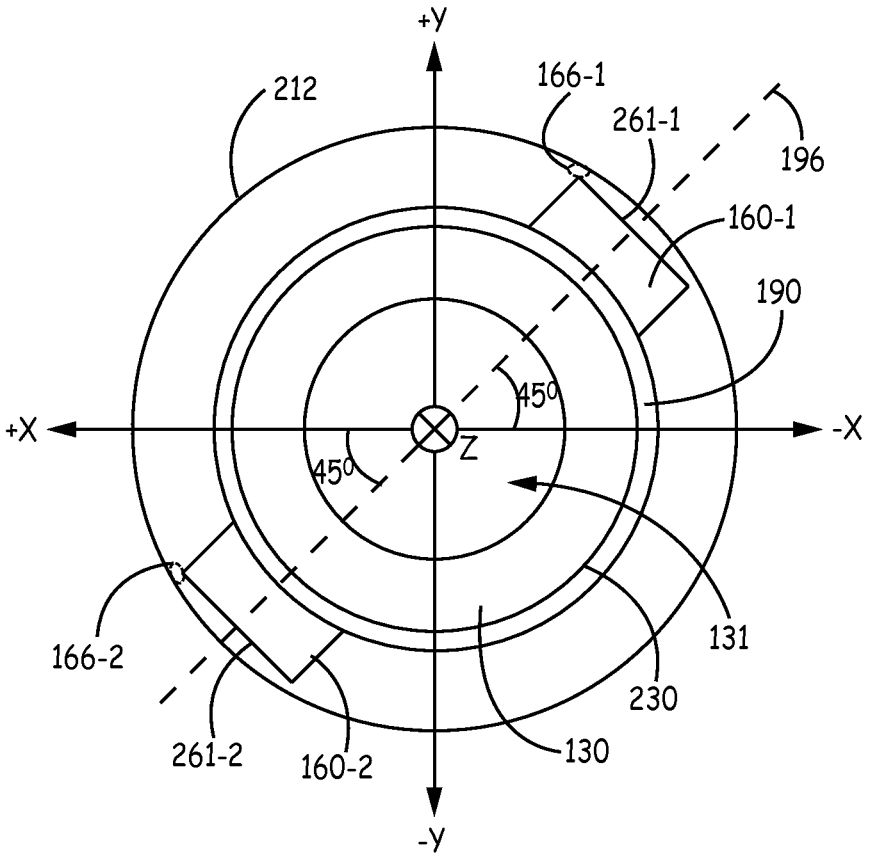
FIG. 6C is an end-view from the input end of a coaxial polarizer with an inner-conductive tube on which dielectric bars are positioned for left-hand-circular polarization when excited by the $TE_{11}$ mode shown in FIG. 6A.

FIG. 6A shows a $TE_{11}$ mode oriented parallel to the X axis. FIG. 6B is an end-view from the input end 145 of a coaxial polarizer 10 with an inner-conductive tube 130 on which dielectric bars 160-1 and 160-2 are positioned for right-hand-circular polarization when excited by the $TE_{11}$ mode shown in FIG. 6A. FIG. 6C is an end-view from the input end 145 of a coaxial polarizer 10 with an inner-conductive tube 130 on which dielectric bars 160-1 and 160-2 are positioned for left-hand-circular polarization when excited by the $TE_{11}$ mode shown in FIG. 6A.

As shown in FIG. 6A, the input electric field of the input electromagnetic wave that is incident upon the coaxial polarizer 10 is a horizontally polarized (e.g., parallel to the X axis) $TE_{11}$ mode. By positioning the dielectric bars 160-1 and 160-2 at a 45 degree orientation with respect to the input $TE_{11}$ mode (e.g., with respect to the X axis) the electromagnetic wave output from the output end 146 (FIG. 1) of the coaxial polarizer 10 (FIG. 1) is either right hand circularly polarized or left hand circularly polarized.

As shown in FIGS. 6A-6C, the inner surface 211 (FIG. 1) of the outer-conductive tube 110 is represented generally at 212. As shown in FIGS. 6B and 6C, the dielectric bars 160-1 and 160-2 are separated from the inner surface 211 (FIG. 1) of the outer-conductive tube 110 by the gaps represented generally at 166-1 and 166-2, respectively.

As shown in FIG. 6B, a line 195 taken perpendicular to the flat surface 261-1 of dielectric bar 160-1 that intersects the center of the inner-conductive tube 130 is at 45 degrees with respect to the positive X axis (+X) in the quadrant of the dielectric bar 160-1. Since the dielectric bar 160-2 is on the outer surface 230 of the inner-conductive tube 130 opposing the dielectric bar 160-1, the line 195 is also perpendicular to the flat surface 261-1 of dielectric bar 160-2. Thus, the line 195 in the quadrant of the dielectric bar 160-2 is at 45 degrees with respect to the negative X axis (−X). This configuration of the dielectric bars 160-1 and 160-2 with reference to input horizontal $TE_{11}$ mode (FIG. 6A) results in the electromagnetic wave output from the output end 146 (FIG. 1) of the coaxial polarizer 10 (FIG. 1) being right hand circularly polarized.

As shown in FIG. 6C, the orientation of the dielectric bars 160-1 and 160-2, with respect to the X axis, is rotated by 90 degrees from the orientation of the dielectric bars 160-1 and 160-2 in FIG. 6B. As shown in FIG. 6C, a line 196 taken perpendicular to the flat surface 261-1 of dielectric bar 160-1 that intersects the center of the inner-conductive tube 130 is at 45 degrees with respect to the negative X axis (−X) in the quadrant of the dielectric bar 160-1. Since the dielectric bar 160-2 is on the outer surface 230 of the inner-conductive tube 130 opposing the dielectric bar 160-1, the line 196 is also perpendicular to the flat surface 261-2 of dielectric bar 160-2. Thus, the line 196 in the quadrant of the dielectric bar 160-2 is at 45 degrees with respect to the positive X axis (+X). This configuration of the dielectric bars 160-1 and 160-2 with reference to the input horizontal $TE_{11}$ mode (FIG. 6A) results in the electromagnetic wave output from the output end 146 (FIG. 1) of the coaxial polarizer 10 (FIG. 1) being left hand circularly polarized.

Figure 7:
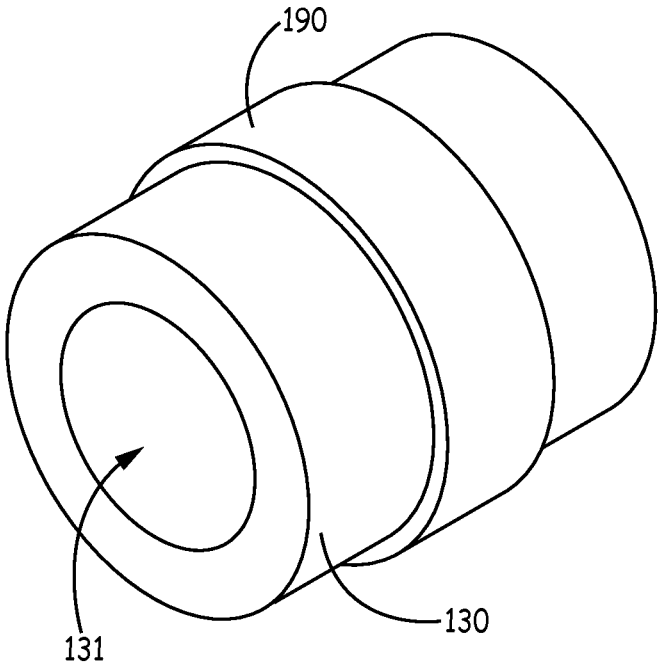
FIG. 7 is an oblique view of one embodiment of a metal ring for use on an inner-conductive tube of a coaxial polarizer.

FIG. 7 is an oblique view of one embodiment of a metal ring 190 for use on an inner-conductive tube 130 of a coaxial polarizer 10 (FIG. 1). The metal ring 190 is manufactured as part of the inner-conductive tube 130. The metal ring 190 encircles the outer surface 230 of the inner-conductive tube 130. The metal ring 190 is offset, along the Z axis, from the shallow-cavities 162-1 and 162-2 and thus is also offset from the dielectric bars 160-1 and 160-2 when they are positioned in the respective shallow-cavities 162-1 and 162-2.

Figure 8B:
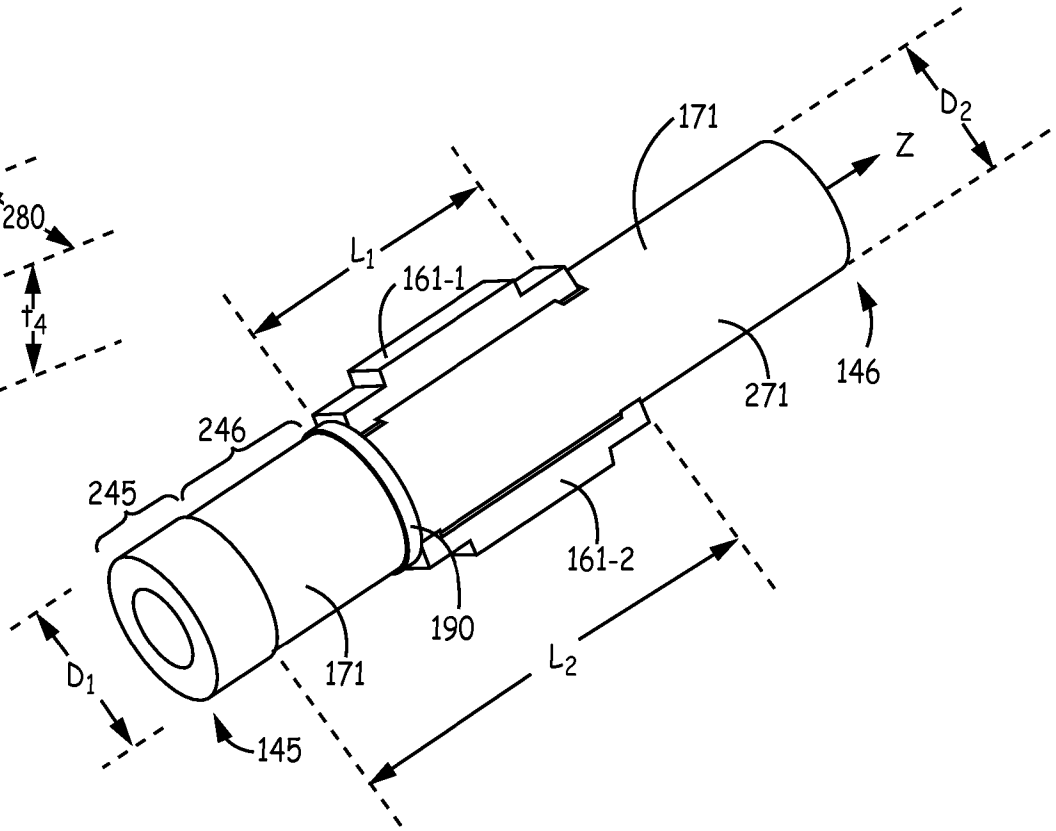
FIG. 8B is an oblique view of an embodiment of an inner-conductive tube with two of the dielectric bars of FIG. 8A.
Figure 8A:
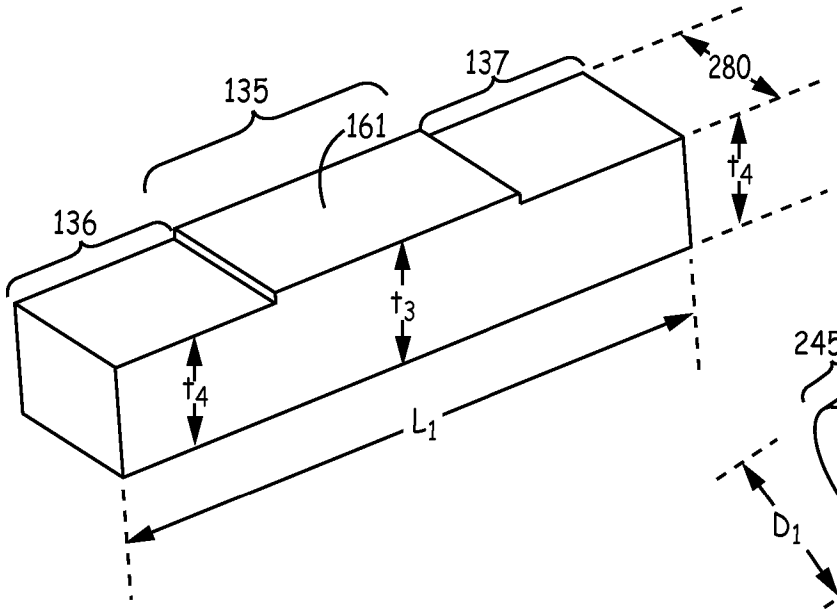
FIG. 8A is an oblique view of an alternate embodiment of a dielectric bar for use on an inner-conductive tube of a coaxial polarizer.

FIG. 8A is an oblique view of an alternate embodiment of a dielectric 161 for use on an inner-conductive tube 171 of a coaxial polarizer 10. The dielectric bar 161 has a length $L_1$. The dielectric bar 161 includes a central portion represented generally at 135 having a thickness $t_3$. The dielectric bar 161 includes side portions represented generally at 136 and 137 having a thickness $t_4$. The thickness $t_3$ is greater than the thickness $t_4$. Thus, the dielectric bar 161 has the shape of three stepped rectangular prisms.

FIG. 8B is an oblique view of an embodiment of an inner-conductive tube 171 with two of the dielectric bars 161-1 and 161-2 of FIG. 8A. As shown in FIG. 8B, the section 245 of the inner-conductive tube 171 at the input end 145 has a diameter $D_1$ that is larger than the diameter $D_2$ of the inner-conductive tube 171 at the output end 146. The section 246 of the inner-conductive tube 171 between the section 245 and the metal ring 190 has a diameter that is smaller than the diameter $D_1$. As shown in FIG. 8B, the dielectric bars 161-1 and 161-2 of FIG. 8A are positioned in and attached to the shallow-cavities (not labeled in FIG. 8B) of the inner-conductive tube 171.

Figure 9B:
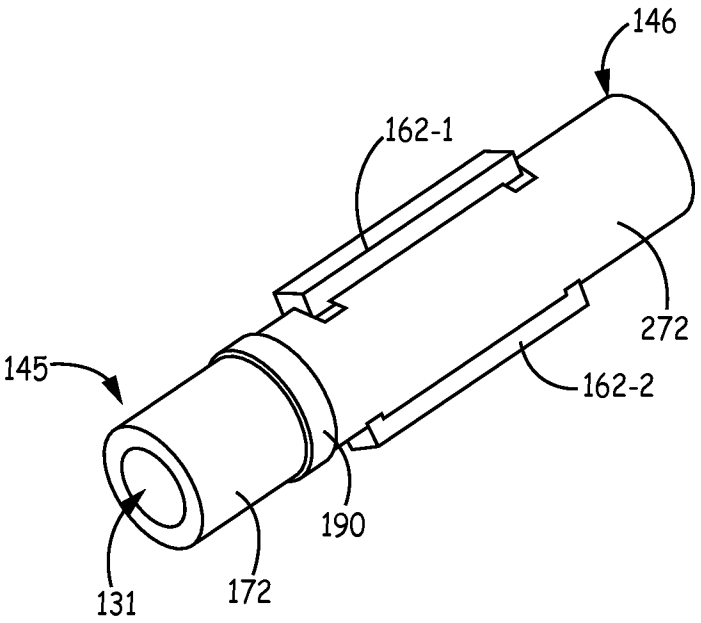
FIG. 9B is an oblique view of an embodiment of an inner-conductive tube with two of the dielectric bars of FIG. 9A.
Figure 9A:
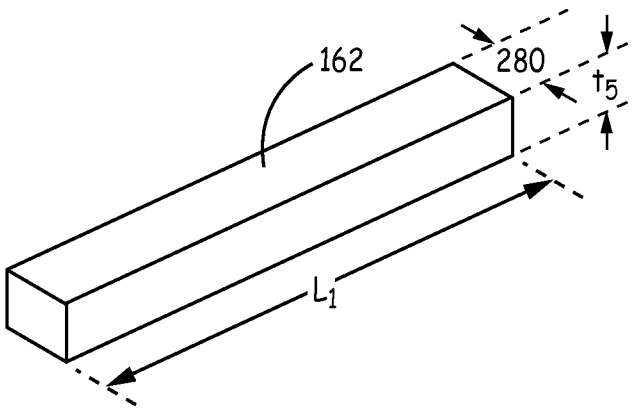
FIG. 9A is an oblique view of an alternate embodiment of a dielectric bar for use on an inner-conductive tube of a coaxial polarizer.

FIG. 9A is an oblique view of an alternate embodiment of a dielectric bar 162 for use on an inner-conductive tube 172 of a coaxial polarizer 10. The dielectric bar 162 is a rectangular prism having a single thickness $t_5$ along the length of $L_1$ of the dielectric bar 162. FIG. 9B is an oblique view of an embodiment of an inner-conductive tube 172 with two of the dielectric bars 162-1 and 162-2 of FIG. 9A. As shown in FIG. 9B, the dielectric bars 162-1 and 162-2 of FIG. 9A are positioned in and attached to the shallow-cavities (not labeled in FIG. 9B) of the inner-conductive tube 171. As shown in FIG. 9B, the inner-conductive tube 172 includes a metal ring 190.

In one implementation of this embodiment, the dielectric bars 162-1 and 162-2 of FIG. 9A are attached to the inner-conductive tube 130 of FIG. 3. In another implementation of this embodiment, the dielectric bars 162-1 and 162-2 of FIG. 9A are attached to the inner-conductive tube 171 of FIG. 8B. In yet another implementation of this embodiment, the dielectric bars 161-1 and 161-2 of FIG. 8A are attached to the inner-conductive tube 172 of FIG. 9B.

Figure 10B:
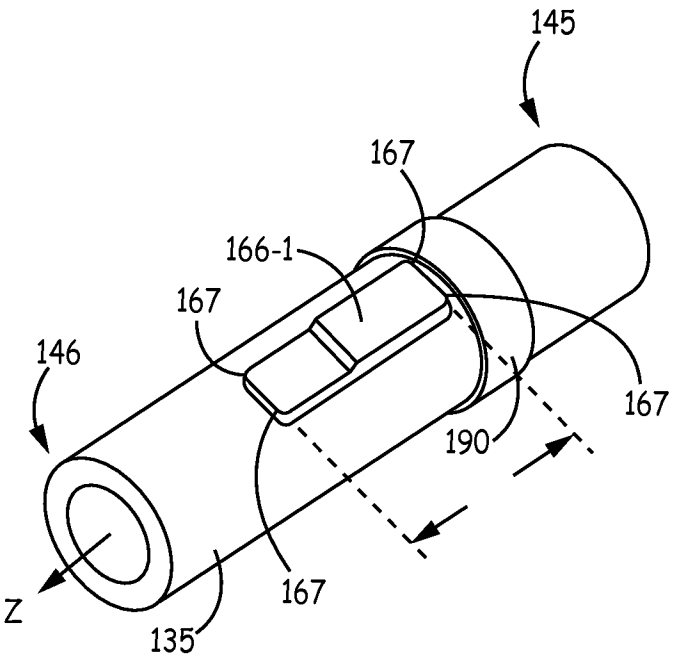
FIG. 10B is an oblique view of an alternate embodiment of the inner-conductive tube of FIG. 10A with a dielectric.
Figure 10A:
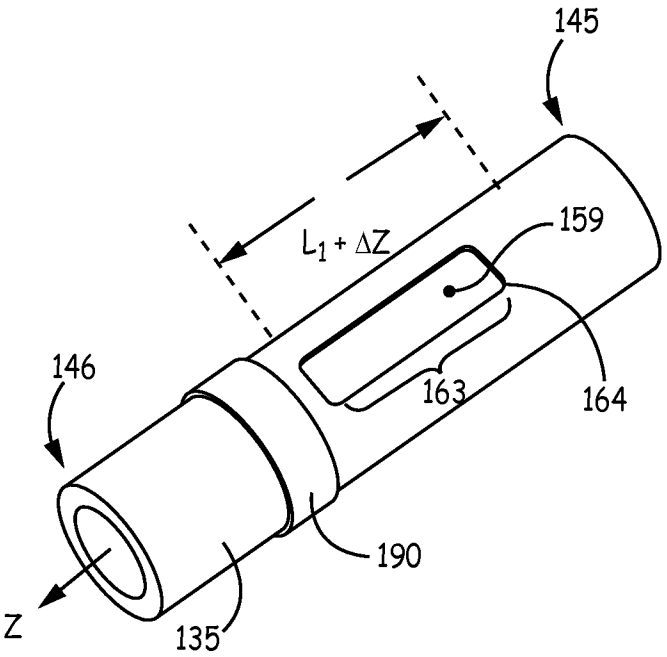
FIG. 10A is an oblique view of an alternate embodiment of an inner-conductive tube.
Figure 10C:
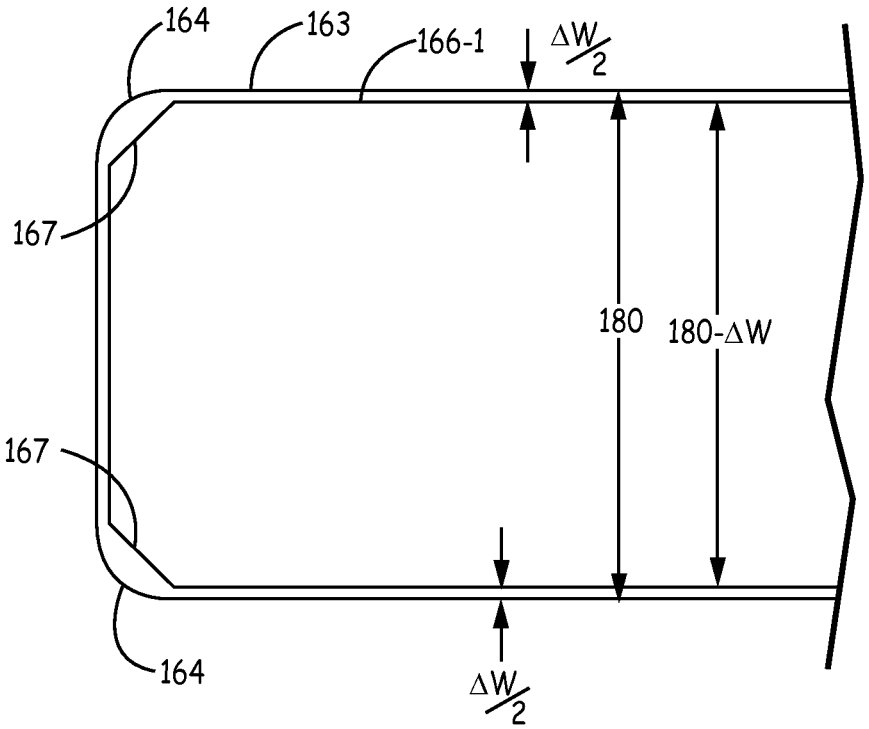
FIG. 10C is an enlarged view of the dielectric positioned in the shallow-cavity of FIG. 10B.

FIG. 10A is an oblique view of an alternate embodiment of an inner-conductive tube 135. In this embodiment, the planar area of the shallow-cavity 163 includes a single planar area (159) that is rectangular in shape. Due to the machining process, the rectangular shaped shallow-cavity 163 has rounded corners represented generally at 164. FIG. 10 B is an oblique view of an alternate embodiment of the inner-conductive tube 135 with a dielectric bar 166-1. A second dielectric bar on the opposing side of the inner-conductive tube 135 is not visible, but that second dielectric bar has the same structure and function as the dielectric bar 166-1. FIG. 10C is an enlarged view of the dielectric bar 166-1 positioned in and attached to the shallow-cavity 163 of FIG. 10A.

The dielectric bar 166 differs from the dielectric bar 160-1 shown in FIG. 5A, in that the dielectric bar 166 has chamfered-edges represented generally at 167 (FIG. 10C) on the edges that are perpendicular to the flat-first surface 260 (FIGS. 5B-5C) of the dielectric bar 166-1. The chamfered-edges 167 are also referred to herein as "vertical-corner edges 167". The chamfered-edges 167 are proximal to a respective rounded corner 164 when the flat-first surface 260 of the dielectric bar 166-1 contacts at least a portion of the planar area of the shallow-cavity 163. As shown in FIG. 10C, the dielectric bar 166 is slightly smaller in dimension than the rectangular shaped shallow-cavity 163. The width 180 of the rectangular shaped shallow-cavity 163 is larger by $\Delta W$ than the width of the dielectric bar 166.

Figure 11:
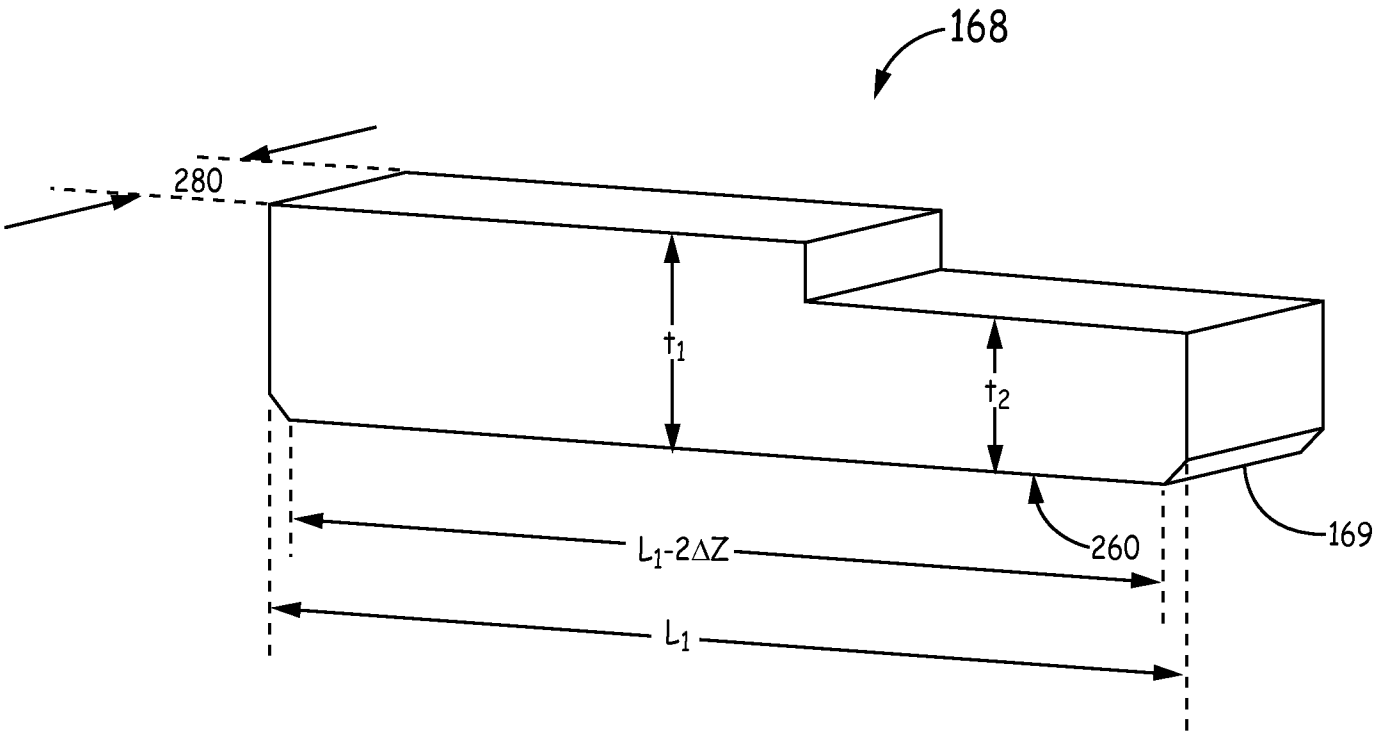
FIG. 11 is an oblique view of an alternate embodiment of a dielectric bar for use on an inner-conductive tube of a coaxial polarizer.
Figure 12A:
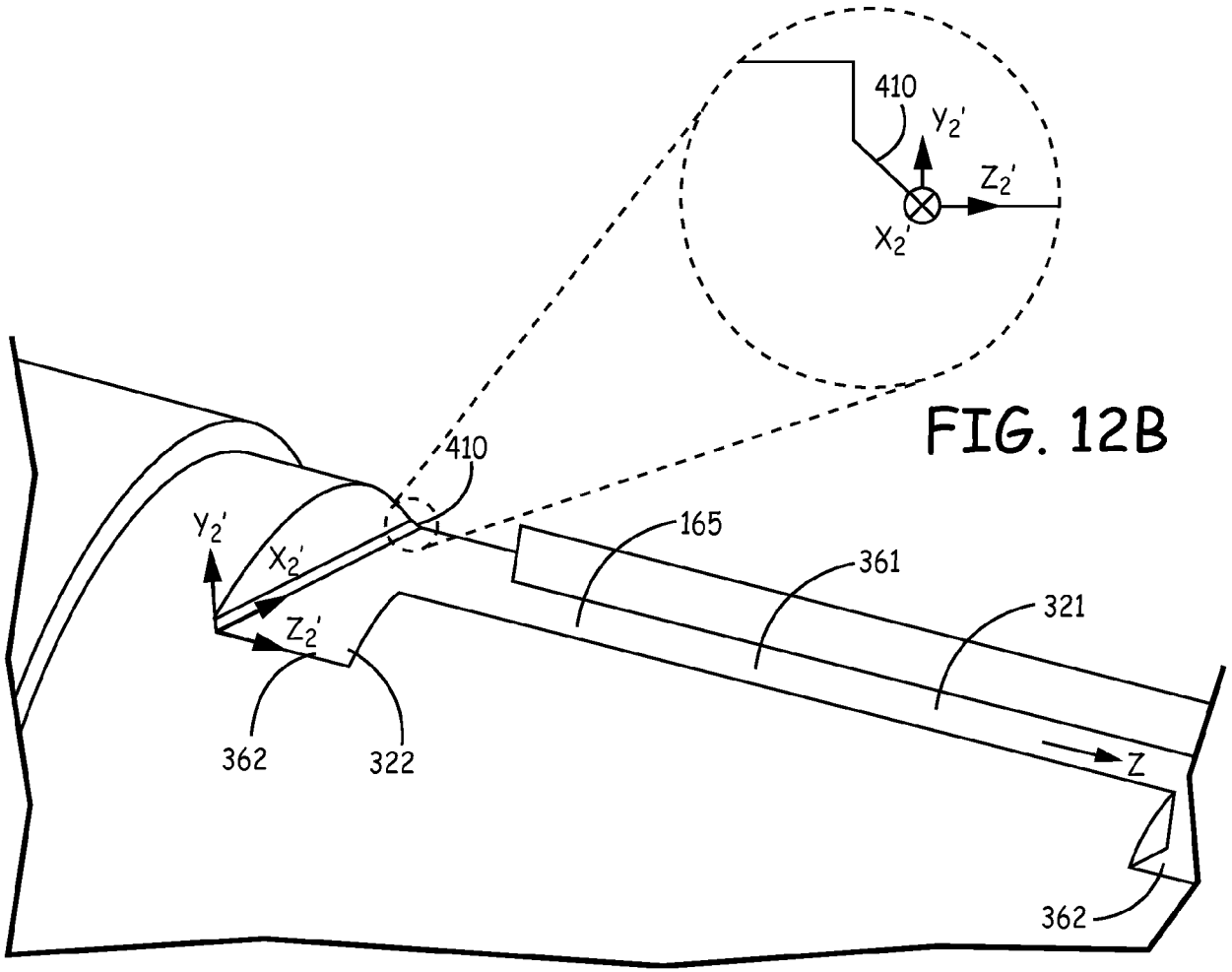
FIG. 12A is an enlarged view of one end of a shallow-cavity.

FIG. 11 is an oblique view of an alternate embodiment of a dielectric bar 168 for use on an inner-conductive tube 130 of a coaxial polarizer 10. FIG. 12A is an enlarged view of one end of a shallow-cavity 165. The shallow-cavity 165 has the I-beam shape of the shallow-cavity 162 (FIGS. 3 and 4). FIG. 12A shows the shallow-cavity 165 has the second planar area 322 in the second section 362 that is adjoined to and parallel to the first planar area 321 in the first section 361. The second planar area 322 has an edge 410 along the $X_2'$ axis. FIG. 12B is an enlarged view of the edge 410 shown in FIG. 12A. As is clearly shown in FIG. 12B, the edge 410 is not formed as a right angle corner but is formed with a chamfered corner. This chamfering of the edge 410 is due to practical machining considerations with end-mills, which are worn down with use. The wear of the end-mills cause chamfers or radii in the interior corners of the milled surface. The dielectric bar 168 shown in FIG. 11 has chamfered corners 169 at the edges of the flat-first surface 260 that are perpendicular to the dielectric length $L_1$ of the dielectric bar 168. The chamfered corners 169 allow for the dielectric bar 168 to be almost as long as the shallow-cavity 165 and to be positioned in the shallow-cavity 362 without hitting the chamfered edge 410. If a dielectric bar does not have a chamfered corners, the dielectric bar is shortened in length (along the Z direction) so the flat-first surface 260 of the dielectric bar does not sit on the chamfered edge 410. If an edge of the flat-first surface 260 of a dielectric bar were to sit on the chamfered edge 410 (FIGS. 12A and 12B), the flat-first surface 260 (FIGS. 5B-5D) would not be parallel to the second planar area 322 in the second section 362 of the shallow-cavity 165 (FIG. 12A).

Figure 13:
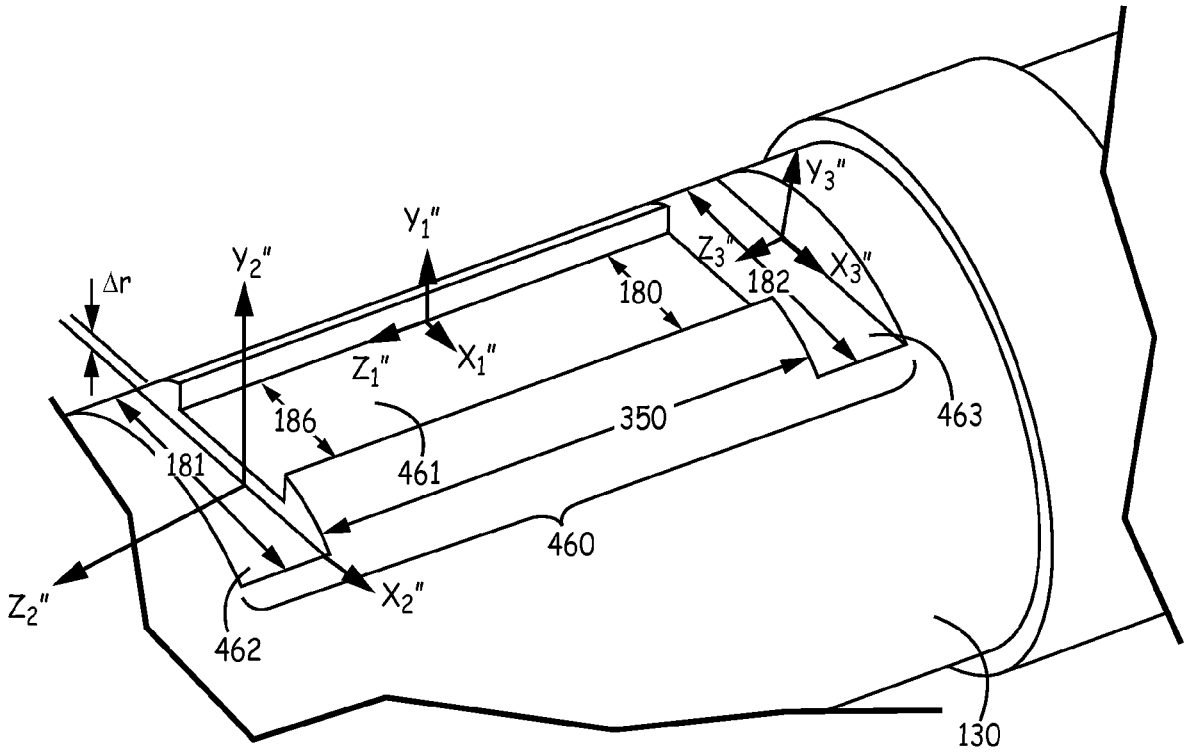
FIG. 13 is an enlarged view of an alternate embodiment of a shallow-cavity.

FIG. 13 is an enlarged view of an alternate embodiment of a shallow-cavity 460. The shallow-cavity 460 is designed to avoid problems due to the chamfering of the edge 410 shown in FIGS. 12A and 12B. The shallow-cavity 460 includes: a first-planar area 461 that spans a first plane $X_1''$-$Z_1''$ in the first section 361; a second-planar area 462 that spans a second plane $X_2''$-$Z_2''$ in the second section 362; and a third planar area 463 that spans a third plane $X_3''$-$Z_3''$ in the third section 363. The second plane $X_2''$-$Z_2''$ is offset by $-\Delta r$ in a negative radial direction (e.g., in the $-Y_2''$ direction) from the first plane $X_1''$-$Z_1''$. The third plane $X_3''$-$Z_3''$ is offset by $-\Delta r$ in the negative radial direction (e.g., in the $-Y_3''$ direction) from the first plane $X_1''$-$Z_1''$. In one implementation of this embodiment, the third plane $X_3''$-$Z_3''$ and the second plane $X_2''$-$Z_2''$ span a common plane.

The first-section-planar area 461 that spans the first plane $X_1''$-$Z_1''$ has a first-cavity width 180 equal to the first-minimum width 180. The first-section-planar area 461 is perpendicular to the first radial direction $r_1$ (FIG. 2) of the inner-conductive tube 130.

The second-section-planar area 462 that spans the second plane $X_2''$-$Z_2''$ has a second-cavity width 181. The second-section-planar area 462 is perpendicular to the first radial direction $r_1$ (FIG. 2) of the inner-conductive tube 130. The third-section-planar area 463 that spans the second plane $X_3''$-$Z_3''$ has a third-cavity width 182. The third-section-planar area 463 is perpendicular to the first radial direction $r_1$ (FIG. 2) of the inner-conductive tube 130. The second-section-planar area 462 and the third-section-planar area 463 are offset from each other in the Z direction by a length 350 of the first-section-planar area 461, and wherein the second-cavity width 181 and third-cavity width 182 are larger than the first-minimum width 180. The embodiments of shallow-cavity 165 and 460 shown in FIGS. 12A and 13 provide a precise alignment in the Z-direction of a dielectric bar inserted into the shallow-cavity 165 or 460. These embodiments of shallow-cavity 165 and 460 are used for parts requiring very tight tolerances.

The coaxial polarizer is designed using a full-wave electromagnetic field solver software package such as ANSYS HFSS, commercially available from ANSYS, Inc., or CST Microwave Studio, commercially available from CST Computer Simulation Technology AB. The coaxial polarizer of this application is useful in dual-frequency concentric antenna feeds. The space 125 must be large enough so that the first frequency band is above the $TE_{11}$ cutoff frequency for the coaxial waveguide and, hence, electromagnetic waves within this first intended frequency band will propagate in the coaxial waveguide. The circular waveguide diameter must be chosen to be large enough so that the second frequency band is above the $TE_{11}$ cutoff frequency and, hence, electromagnetic waves within this second intended frequency will propagate in the circular waveguide. The outer tube diameter must be small enough to meet the space constraints of the system in which it is being installed. Additionally, the inner tube wall thickness must be of sufficient size to allow room for the shallow cavities for a chosen dielectric bar width which is also a key parameter in the design. The inner and outer conductor tube diameters and the inner tube wall thickness are typically chosen in advance of computer optimization runs based on the constraints above. Then, the width of the dielectric bars 161-1 and 161-2 and the lengths and thicknesses of the various sections of the dielectric bars are adjusted to optimize the performance of the coaxial polarizer in the first frequency band. Specifically, the goal of the computer controlled optimizer is to find the dielectric bar geometry which minimizes the axial ratio of the polarizer such that the resulting electromagnetic field polarization at the output of the polarizer is circular. Additionally, in some embodiments, the return loss of the input electromagnetic wave may be optimized through adjustment of the geometry and the location of the conductive ring 190 (FIG. 7). In other embodiments, the return loss of the input electromagnetic wave may be optimized through adjustment of the geometry and the location of the quarter-wave-transformer 246 (FIG. 8B).

In one embodiment of the inner-conductive tube 171 shown in FIG. 8B, the diameter of the inner conductor at the input end 145 and the diameter of the inner conductor at the output end 146 are different. This feature is useful in designs where a radiator section connected to the output port has a different inner conductor diameter than the rectangular-waveguide-to-coaxial-waveguide transition section connected to the input port. In this embodiment, the section with the metal ring 190 also has a larger diameter than the section 246. The section 246 of reduced diameter is a quarter-wave-transformer 246 designed to achieve a low return loss for the input wave. With the quarter-wave-transformer 246, the return loss is optimized. The dielectric bars 161-1 and 161-2 have a length $L_1$. The overall length of the coaxial polarizer including the quarter-wave-transformer 246 is length $L_2$.

Figure 14:
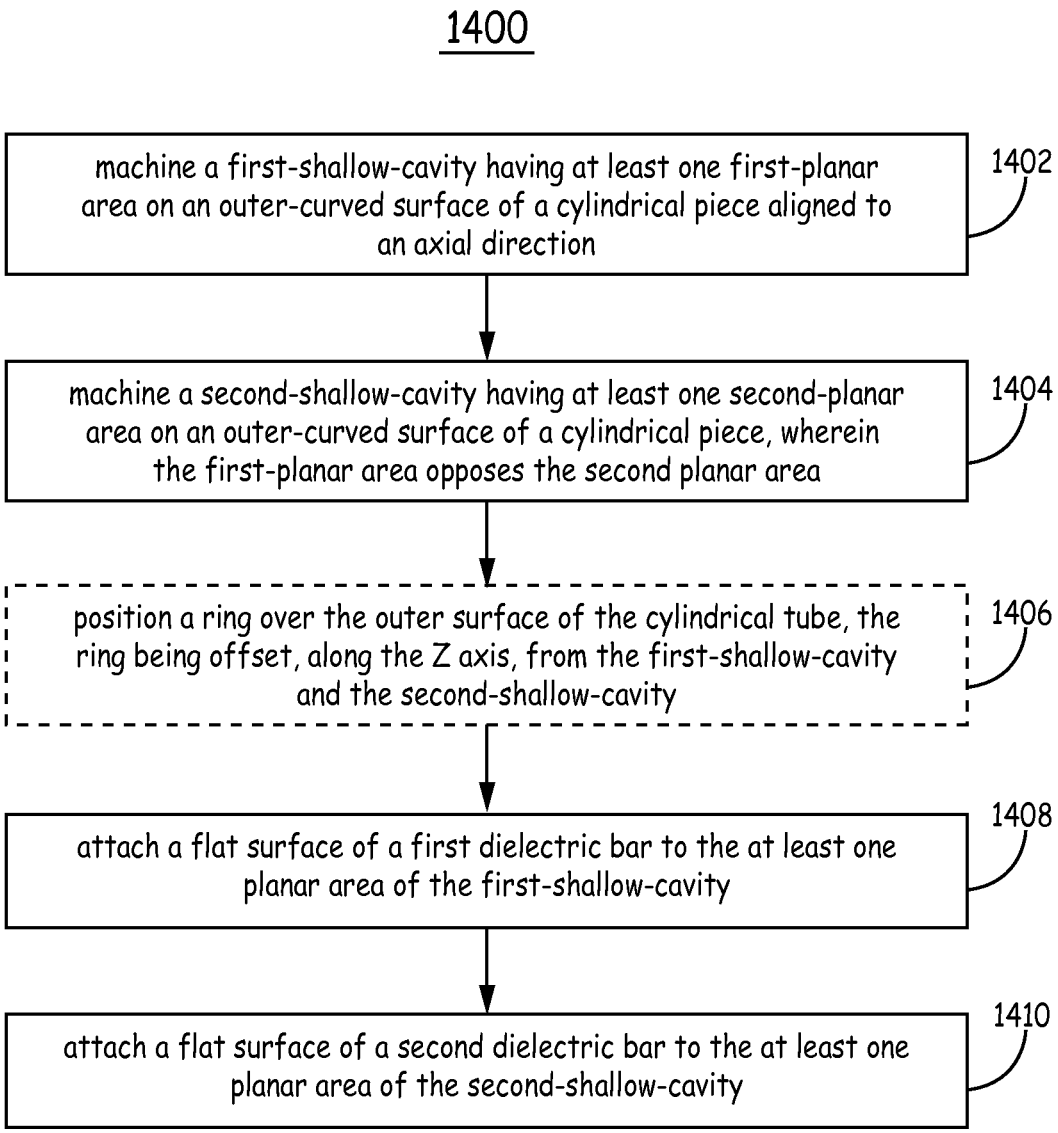
FIG. 14 is a flow diagram of a method of making an inner-conductive tube.

FIG. 14 is a flow diagram of a method 1400 of making an inner-conductive tube 130. Method 1400 is applicable to a coaxial polarizer formed from any combination of the embodiments of shallow cavities and dielectric bars described in FIGS. 1-13.

At block 1402, a first shallow-cavity 162 having at least one first-planar area is machined on an outer-curved surface of a cylindrical piece aligned to an axial direction. As defined herein, a cylindrical piece is either a solid metal cylinder or a metal cylindrical tube. In one implementation of this embodiment, machining is done on a solid metal cylinder and the piece is later machined to bore a hole axially into the solid metal cylinder to form a metal cylindrical tube. In another implementation of this embodiment, the machining is done on a solid metal cylinder and the piece is used for a single frequency band coaxial polarizer.

At block 1404, a second shallow-cavity 162 having at least one second-planar area 162-2 is machined on the outer-curved surface of the cylindrical piece, wherein the first-planar area opposes the second planar area.

In one implementation of this embodiment, the processes at block 1402 and 1404 are performed as follows. A first-planar area is machined in a first section 361 of the first shallow-cavity 162. Then a second-planar area is machined in a second section 362 of the first shallow-cavity 162. Then a third-planar area is machined in a third section 363 of the first shallow-cavity 162. The first-planar area has a length parallel to the axial direction and a width equal to a minimum width. The second-planar area has a second width greater than the minimum width 180. The second-planar area adjoins the first-planar area at a first end of first-planar area. The third-planar area has a third width greater than the minimum width 180. The third-planar area adjoins the first-planar area at a second end of first-planar area.

In another implementation of this embodiment, the processes at block 1402 and 1404 are performed as follows. A first-planar area is machined in a first section 361 of the first region parallel to the axial direction for an extent equal to a cavity length 140. A second-planar area is machined in a second section 362 of the first shallow-cavity 162. A third-planar area is machined in a third section 363 of the first shallow-cavity 162. The second-planar area has a second length perpendicular to the axial direction. The second-planar area is offset in a negative radial direction from the first-planar area. The third-planar area has a third length perpendicular to the axial direction. The third planar area is offset in a negative radial direction from the first-planar area.

In yet another implementation of this embodiment, first and second rectangular planar surfaces are machined in opposing first and second sections to have a length larger than the length of the dielectric bars. In one embodiment of this case, the vertical-corner edges of the dielectric bars that are parallel to the radial direction of the cylindrical piece, when installed, are chamfered. In another embodiment of this case, dielectric bar has chamfered corners at the edges of the flat-first surface that are perpendicular to the dielectric bar length. In yet another embodiment of this case, the dielectric bars have chamfered vertical-corner edges and chamfered corners at the edges of the flat-first surface that are perpendicular to the dielectric bar length.

Block 1406 is optional. At block 1406, a metal ring 190 is positioned over the outer surface 230 of the cylindrical tube. The metal ring 190 is offset, along the Z axis, from the first shallow-cavity 162 and the second shallow-cavity 162. In one implementation of this embodiment, the metal ring 190 is formed by machining the outer surface 131 of the inner-conductive tube 130. In another implementation of this embodiment, the metal ring 190 is formed as a separate piece from the inner-conductive tube 130 and is then positioned on the outer surface 131 of the inner-conductive tube 130.

At block 1408, a flat surface of a first dielectric bar is attached to the at least one planar area of the first shallow-cavity. In one implementation of this embodiment, the flat surface of a first dielectric 160-1 is positioned inside the first shallow-cavity 162-1 and then the flat surface of the first dielectric 160-1 is glued to the at least one planar area of the first shallow-cavity 162. In this manner, a flat-first surface of first dielectric 160-1 is parallel to and attached to a planar area in a first shallow-cavity 162-1 on the surface of the inner conductive tube 130.

At block 1410, a flat surface of a second dielectric bar is attached to the at least one planar area of the second shallow-cavity. In one implementation of this embodiment, the flat surface of a second dielectric 160-2 is positioned inside the second shallow-cavity 162 and the flat surface of the second dielectric 160-2 is glued to the at least one planar area of the second shallow-cavity 162. In this manner, a flat-first surface of second dielectric 160-2 is parallel to and attached to a planar area in a second shallow-cavity 162-2 on the surface of the inner conductive tube 130.

Thus, the various embodiments of the coaxial polarizers formed from the inner conductive tubes shown in FIGS. 1, 2, 3, 4, 6B, 6C, 8B, 9B, 10B, 10C, 12, and 13 and the dielectric bars shown in FIGS. 2, 5A-5D, 6B, 6C, 8A, 8B, 9A, 10B, 10C, and 11 do not require any protrusions on the outer surface of the conductive inner tube to which the dielectric bars are mated in a snap-fit fashion. Rather, the at least one flat surface of the dielectric bar is guided into a shallow cavity and attached to a flat surface of the shallow cavity. These conductive tubes and the dielectric bars are formed without complex machining processes, thus they are low cost and easy to assemble.

Figure 15:
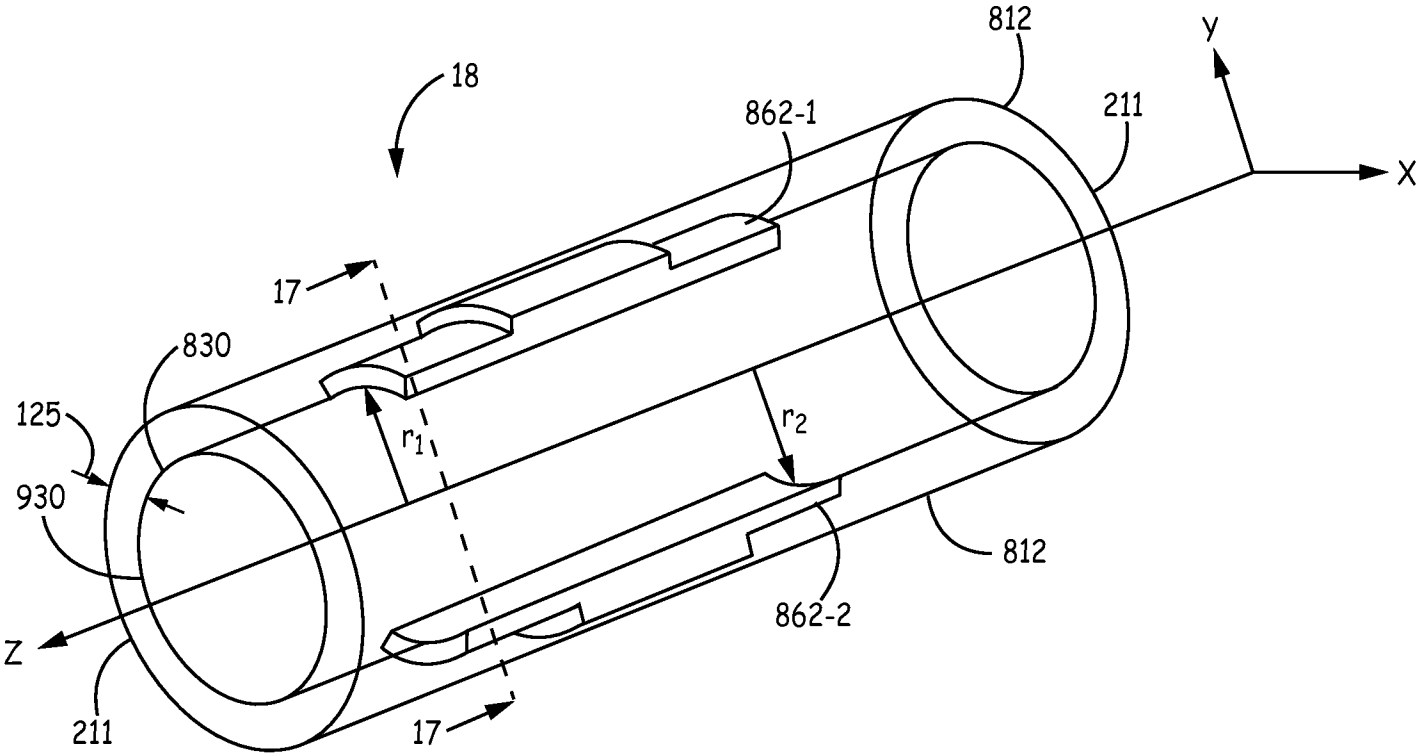
FIG. 15 is an oblique view of an alternate embodiment of a coaxial polarizer with an inner-conductive tube and alternate dielectric bars.
Figure 16:
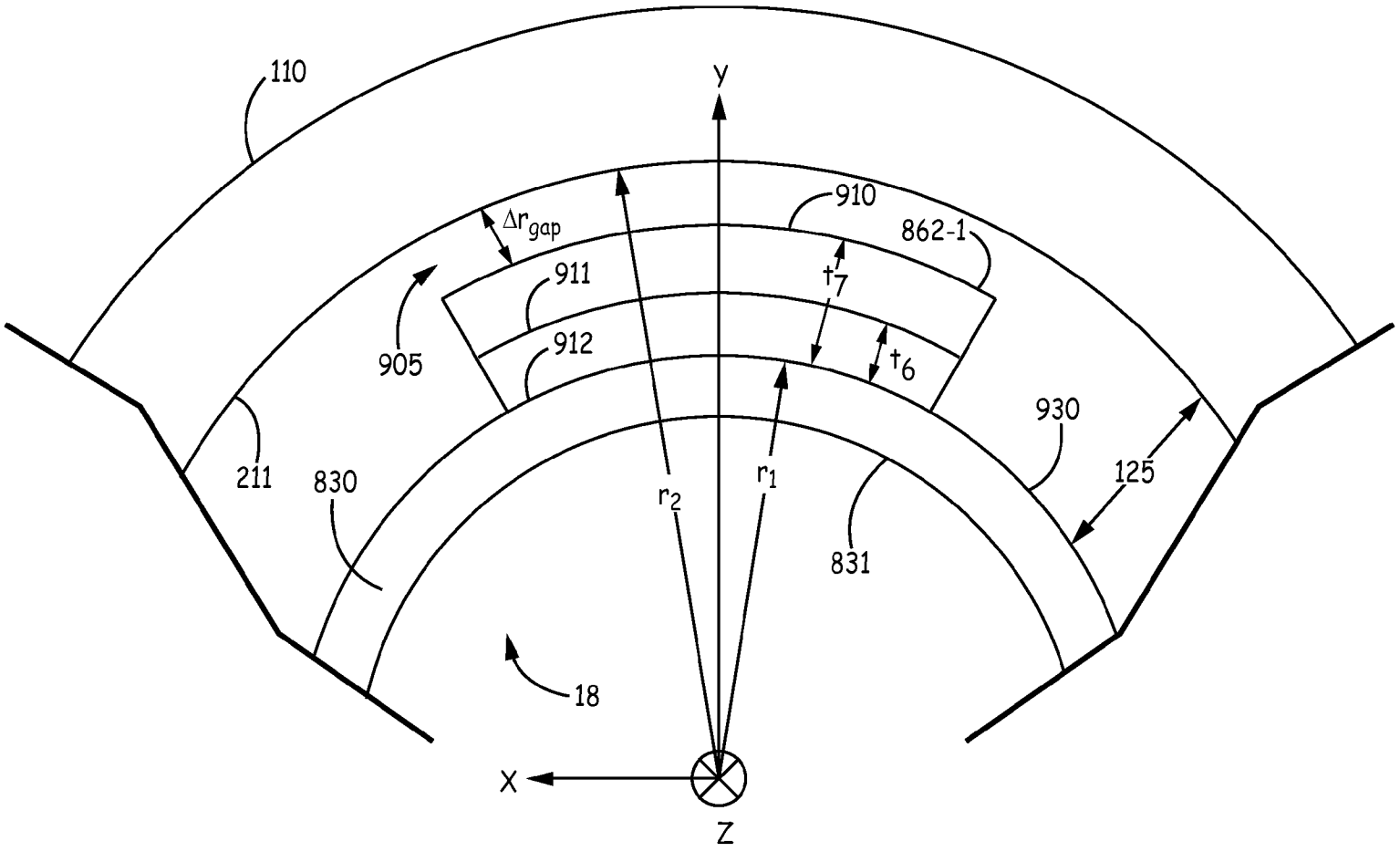
FIG. 16 is an enlarged end view of a portion of the coaxial polarizer of FIG. 15.
Figure 17:
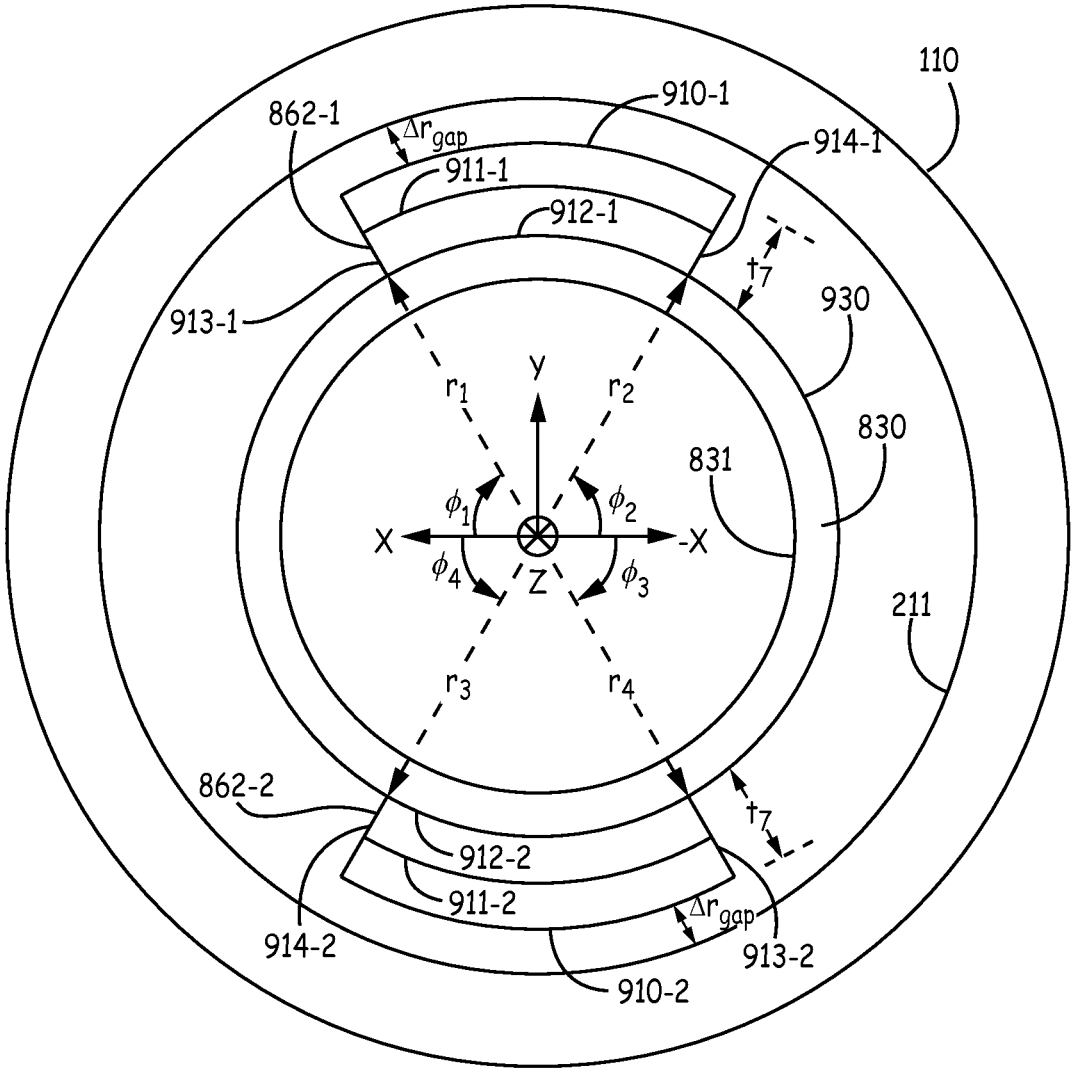
FIG. 17 is an end view of the outer-conductive tube, the inner-conductive tube, and the dielectric bars of FIG. 15.

FIG. 15 is an oblique view of an outer surface 930 of an alternate embodiment of a coaxial polarizer with an inner-conductive tube 830 and alternate dielectric bars 862-1 and 862-2. FIG. 15 shows an outline 812 of the inner surface 211 of the outer-conductive tube 110 (FIGS. 1 and 16), which is not shown in FIG. 15 in order for the dielectric bars 862-1 and 862-2 to be visible. Only the outer surface 930 of inner-conductive tube 830 is visible in FIG. 15. FIG. 16 is an enlarged end view of a portion of the coaxial polarizer 18 of FIG. 15. FIG. 17 is an end view of the outer-conductive tube 110, the inner-conductive tube 830, and the dielectric bars 862-1 and 862-2 of FIG. 15. The coaxial polarizer 18 differs from the coaxial polarizer 10 in that there is no planar surface on the outer surface 930 of inner-conductive tube 830 and the dielectric bars 862-1 and 862-2 have curved surfaces which are attached to the curved outer surface 930 of inner-conductive tube 830.

The coaxial polarizer 18 includes an outer-conductive tube 110 (of which only a portion is visible in FIG. 16), an inner-conductive tube 830 positioned within the outer-conductive tube 110 and axially aligned with the outer-conductive tube 110, a first dielectric 862-1 positioned on the curved outer surface 930 of the inner-conductive tube 830, and a second dielectric 862-2 positioned on the curved outer surface 930 of the inner-conductive tube 830 opposing the first dielectric 862-1.

The inner-conductive tube 830 has an axial dimension parallel to a Z axis and an outer surface 930 (FIG. 16) with a radius of curvature $r_1$ (FIG. 16). The outer-conductive tube 110 has an axial dimension parallel to a Z axis and an inner surface 211 (FIG. 16) with a radius of curvature $r_2$ (FIG. 16). The difference between the radius of curvature $r_2$ and the radius of curvature $r_1$ is greater than the maximum thickness of the first dielectric 862-1 and the maximum thickness of the second dielectric 862-2. In one implementation of this embodiment, the maximum thickness of the first dielectric 862-1 and the second dielectric 862-2 are the same. A gap represented generally at 905 (FIG. 16) is between the top surface 910 of the first dielectric 862-1 and the inner surface 211 of the outer-conductive tube 110. The gap 905 has a thickness $\Delta r_{gap}$.

As shown in FIG. 17, the first dielectric 862-1 includes a curved first surface 912-1, an opposing curved second surface 911-1, an opposing curved third surface 910-1, a fourth surface 913-1, and a fifth surface 914-1. The fourth surface 913-1 is parallel to the radial direction $r_1$ oriented by the angle $\phi_1$. The fifth surface 914-1 is parallel to the radial direction $r_2$ oriented by the angle $\phi_2$. As shown in FIG. 16, the first curved surface 912 is offset by the thickness t6 from the second curved surface 911 and the first curved surface 912 is offset by the thickness $t_7$ from the third curved surface 910.

As shown in FIG. 17, the second dielectric 862-2 includes a curved sixth surface 912-2, an opposing curved seventh surface 911-2, an opposing curved eighth surface 910-2, a ninth surface 913-2, and a tenth surface 914-2. The ninth surface 913-2 is parallel to the radial direction $r_3$ oriented by the angle $\phi_3$. The tenth surface 914-2 is parallel to the radial direction $r_4$ oriented by the angle $\phi_4$. In one implementation of this embodiment, angle $\phi_1$ equals angle $\phi_2$, equals angle $\theta_3$, and also equals angle $\theta_4$.

The coaxial polarizer 18 can be arranged with reference to an input electromagnetic wave to output either right hand or left hand polarization as described above with reference to the coaxial polarizer 10. As is understandable to one skilled in the art, the various embodiments of shallow cavities on the outer surface of the inner-conductive tube and the various embodiments of dielectric bars can be used in any desired combination to provide many different configurations of the coaxial polarizers.

Example Embodiments

Example 1 includes a coaxial polarizer comprising: an outer-conductive tube; an inner-conductive tube positioned within the outer-conductive tube and axially aligned with the outer-conductive tube, the inner-conductive tube having two shallow-cavities on opposing portions of an outer surface of the inner-conductive tube, the shallow-cavities each having at least one planar area, the at least one planar area having a cavity length parallel to a Z axis and having at least one cavity width that is perpendicular to the Z axis and perpendicular to a radial direction of the inner-conductive tube, the at least one cavity width including a minimum width; and two dielectric bars each having a flat-first surface, the flat-first surface having a dielectric length parallel to the Z axis and a dielectric width perpendicular to the Z axis, the dielectric length being less than the cavity length and the dielectric width being less than the minimum width, wherein cross-sections of each of the two dielectric bars taken perpendicular to the Z axis have four respective surfaces in a rectangular shape, and wherein the two flat-first surfaces of the respective two dielectric bars contact at least a portion of the respective two planar areas of the two shallow-cavities.

Example 2 includes the coaxial polarizer of Example 1, further comprising: a metal ring encircling the outer surface of the inner-conductive tube, the ring being offset, along the Z axis, from the shallow-cavities.

Example 3 includes the coaxial polarizer of any of Examples 1-2, wherein the two opposing planar areas of the respective two shallow-cavities comprises: a first planar area in a first section having a first-cavity width equal to the minimum width, first-cavity width being perpendicular to the Z axis and perpendicular to a radial direction of the inner-conductive tube; a second planar area in a second section adjoined to the first section and having a second-cavity width perpendicular to the Z axis and perpendicular to the radial direction of the inner-conductive tube; and a third planar area in a third section adjoined to the first section having a third-cavity width perpendicular to the Z axis and perpendicular to the radial direction of the inner-conductive tube, wherein the second section and the third section are offset from each other by a length of the first section, and wherein the second-cavity width and the third-cavity width are larger than the minimum width.

Example 4 includes the coaxial polarizer of Example 3, wherein the at least one planar area of at least one of the opposing two shallow-cavities comprises: a first-planar area that spans a first plane in the first section; a second-planar area that spans a second plane in the second section, the second plane being offset in a negative radial direction from the first plane; and a third planar area that spans a third plane in the third section, the third plane being offset in the negative radial direction from the first plane.

Example 5 includes the coaxial polarizer of any of Examples 1-4, wherein at least one of the two dielectric bars has at least one chamfered corner at at least one of the edges of the flat-first surface perpendicular to the dielectric length.

Example 6 includes the coaxial polarizer of any of Examples 1-5, wherein the at least one planar area of the respective two shallow-cavities include a single planar area that is rectangular in shape.

Example 7 includes the coaxial polarizer of Example 6, wherein the rectangular shape of the at least one planar area includes rounded corners, wherein each of the two dielectric bars further comprises: at least one chamfered-edge perpendicular to the flat-first surface, wherein at least one chamfered-edge is proximal to a respective at least one rounded corner when the flat-first surface of the dielectric bar contacts the at least a portion of the planar area of the shallow-cavity.

Example 8 includes the coaxial polarizer of any of Examples 1-7, wherein the cross-sections of each of the two dielectric bars taken perpendicular to the Z axis include: a first-cross-section having a first-rectangular shape including a width that is less than the minimum width, and wherein a second-cross-section having a second-rectangular shape including a width that is less than the minimum width.

Example 9 includes an inner-conductive tube for use in a coaxial polarizer, comprising: a first shallow-cavity on an outer surface of the inner-conductive tube, wherein the first shallow-cavity has a first-full-planar area, the first-planar area having a first-cavity length parallel to a Z axis and having at least one first-cavity width perpendicular to the Z axis and perpendicular to a first radial direction of the inner-conductive tube, the at least one first-cavity width including a first-minimum width; and a second shallow-cavity on the outer surface of the inner-conductive tube, the second shallow-cavity opposing the first shallow-cavity and having a second-full-planar area, the second-full-planar area having a second-cavity length parallel to the Z axis and having at least one second-cavity width perpendicular to the Z axis and perpendicular to a second radial direction of the inner-conductive tube, the at least one second-cavity width including a second-minimum width.

Example 10 includes the inner-conductive tube of Example 9, further comprising: a metal ring encircling the outer surface of the inner-conductive tube, the ring being offset, along the Z axis, from the first shallow-cavity and the second shallow-cavity.

Example 11 includes the inner-conductive tube of any of Examples 9-10, wherein the first-cavity length equals the second-cavity length and the at least one first-cavity width equals the at least one second-cavity width.

Example 12 includes the inner-conductive tube of any of Examples 9-11, wherein the first-full-planar area of the first shallow-cavity comprises: a first planar area in a first section having a first-cavity width equal to the first-minimum width, and first-cavity width being perpendicular to the Z axis and perpendicular to the first radial direction of the inner-conductive tube; a second planar area in a second section adjoined to the first section and having a second-cavity width perpendicular to the Z axis and perpendicular to the first radial direction of the inner-conductive tube; and a third planar area in a third section adjoined to the first section having a third-cavity width perpendicular to the Z axis and perpendicular to the first radial direction of the inner-conductive tube, wherein the second section and the third section are offset from each other by a length of the first section, and wherein the second-cavity width and third-cavity width are larger than the first-minimum width.

Example 13 includes the inner-conductive tube of Example 12, wherein the second-full-planar area of the second shallow-cavity comprises: a fourth planar area in a fourth section having the fourth-cavity width equal to the second-minimum width, the fourth-cavity width being perpendicular to the Z axis and perpendicular to the second radial direction of the inner-conductive tube; a fifth planar area in a fifth section adjoined to the fourth section having a fifth-cavity width perpendicular to the Z axis and perpendicular to the second radial direction of the inner-conductive tube; and a sixth planar area in a sixth section adjoined to the fourth section having a sixth cavity width perpendicular to the Z axis, wherein the fifth section and the sixth section are offset from each other by a length of the fourth section, and wherein the fifth-cavity width and sixth-cavity width are larger than the second-minimum width.

Example 14 includes the inner-conductive tube of any of Examples 9-13, wherein at least one of the first shallow-cavity and the second shallow-cavity comprises: a first-section-planar area that spans a first plane, the first-section-planar area having the first-cavity width equal to the first-minimum width, the first-cavity width being perpendicular to the Z axis and perpendicular to the first radial direction of the inner-conductive tube; a second-section-planar area that spans a second plane adjoining the first plane, the second-section-planar area having a third-cavity width perpendicular to the Z axis and perpendicular to the first radial direction of the inner-conductive tube, the second plane being offset in a negative radial direction from the first plane; and a third-section-planar area that spans a third plane adjoining the first plane, the third-section-planar area having a fourth-cavity width perpendicular to the Z axis and perpendicular to the first radial direction of the inner-conductive tube, the third plane being offset in the negative radial direction from the first plane, wherein the second-section-planar area and the third-section-planar area are offset from each other by a length of the first-section-planar area, and wherein the third-cavity width and the fourth-cavity width are larger than the first-minimum width.

Example 15 includes the inner-conductive tube of any of Examples 9-14, wherein at least one of the first-full-planar area of the first shallow-cavity and the second-full-planar area of the second shallow-cavity is rectangular in shape.

Example 16 includes a method of making an inner-conductive tube, the method comprising: machining a first shallow-cavity having at least one first-planar area on an outer-curved surface of a cylindrical piece aligned to an axial direction; and machining a second shallow-cavity having at least one second-planar area on an outer-curved surface of the cylindrical piece, wherein the first-planar area opposes the second planar area.

Example 17 includes the method of Example 16, wherein machining the first shallow-cavity having the at least one first-planar area on the first region of the outer surface of the cylindrical tube comprises: machining a first-planar area in a first section of the first shallow-cavity, the first-planar area having a length parallel to the axial direction and a first width perpendicular to the axial direction; machining a second-planar area in a second section of the first shallow-cavity, the second-planar area having a second width perpendicular to the axial direction and the second-planar area adjoining the first-planar area at a first end of first-planar area; and machining a third-planar area in a third section of the first shallow-cavity, the third-planar area having a third width perpendicular to the axial direction and the third-planar area adjoining the first-planar area at a second end of first-planar area.

Example 18 includes the method of any of Examples 16-17, wherein machining the first shallow-cavity having the at least one first-planar area on the first region of the outer surface of the cylindrical tube comprises: machining a first-planar area in a first section of the first, the first-planar area having a length parallel to the axial direction and a first width perpendicular to the axial direction; machining a second-planar area in a second section of the first shallow-cavity, the second-planar area having a second width perpendicular to the axial direction, wherein second-planar area is offset in a negative radial direction from the first-planar area; and machining a third-planar area in a third section of the first shallow-cavity, third-planar area having a third width perpendicular to the axial direction, wherein the third planar area is offset in a negative radial direction from the first-planar area.

Example 19 includes the method of any of Examples 16-18, further comprising: positioning a metal ring over the outer surface of the cylindrical tube, wherein the ring is offset, along the Z axis, from the first shallow-cavity and the second shallow-cavity.

Example 20 includes the method of any of Examples 16-19, further comprising: attaching a flat surface of a first dielectric bar to the at least one planar area of the first shallow-cavity; and attaching a flat surface of a second dielectric bar to the at least one planar area of the second shallow-cavity.

A number of embodiments of the invention defined by the following claims have been described. Nevertheless, it will be understood that various modifications to the described embodiments may be made without departing from the spirit and scope of the claimed invention. For example, although the technique for machining an inner-conductive core of a coaxial polarizer is described above, the technique for forming the shallow cavities on the outer surface of the inner-conductive core can include other processes including heating the metal and impressing the shallow cavities on the outer surface of the inner-conductive core or other types of molding or shaping metal. Accordingly, other embodiments are within the scope of the following claims.

What is claimed is:

1. A coaxial polarizer comprising:

an outer-conductive tube;

an inner-conductive tube positioned within the outer-conductive tube and axially aligned with the outer-conductive tube, the inner-conductive tube having two shallow-cavities on opposing portions of an outer surface of the inner-conductive tube, the shallow-cavities each having at least one planar area, the at least one planar area having a cavity length parallel to a Z axis and having at least one cavity width that is perpendicular to the Z axis and perpendicular to a radial direction of the inner-conductive tube, the at least one cavity width including a minimum width; and two dielectric bars each having a flat-first surface, the flat-first surface having a dielectric length parallel to the Z axis and a dielectric width perpendicular to the Z axis, the dielectric length being less than the cavity length and the dielectric width being less than the minimum width, wherein cross-sections of each of the two dielectric bars taken perpendicular to the Z axis have four respective surfaces in a rectangular shape, and wherein the two flat-first surfaces of the respective two dielectric bars contact at least a portion of the respective two planar areas of the two shallow-cavities.

2. The coaxial polarizer of claim 1, further comprising:

a metal ring encircling the outer surface of the inner-conductive tube, the metal ring being offset, along the Z axis, from the shallow-cavities.

3. The coaxial polarizer of claim 1, wherein the at least one planar area of each of the two opposing shallow-cavities comprises:

a first planar area in a first section having a first-cavity width equal to the minimum width, the first-cavity width being perpendicular to the Z axis and perpendicular to the radial direction of the inner-conductive tube;

a second planar area in a second section adjoined to the first section and having a second-cavity width perpendicular to the Z axis and perpendicular to the radial direction of the inner-conductive tube; and a third planar area in a third section adjoined to the first section having a third-cavity width perpendicular to the Z axis and perpendicular to the radial direction of the inner-conductive tube, wherein the second section and the third section are offset from each other by a length of the first section, and wherein the second-cavity width and the third-cavity width are larger than the minimum width.

4. The coaxial polarizer of claim 1, wherein the at least one planar area of at least one of the opposing two shallow-cavities comprises:

a first-planar area that spans a first plane in the first section;

a second-planar area that spans a second plane in the second section, the second plane being offset in a negative radial direction from the first plane; and a third planar area that spans a third plane in the third section, the third plane being offset in the negative radial direction from the first plane.

5. The coaxial polarizer of claim 1, wherein at least one of the two dielectric bars has at least one chamfered corner located on at least one edge of the flat-first surface perpendicular to the dielectric length.

6. The coaxial polarizer of claim 1, wherein the at least one planar area of the respective two shallow-cavities include a single planar area that is rectangular in shape.

7. The coaxial polarizer of claim 6, wherein the rectangular shape of the at least one planar area includes rounded corners, wherein each of the two dielectric bars further comprises:

at least one chamfered-edge perpendicular to the flat-first surface, wherein the at least one chamfered-edge is proximal to a respective at least one rounded corner when the flat-first surface of the dielectric bar contacts the at least a portion of the planar area of the shallow-cavity.

8. The coaxial polarizer of claim 1, wherein the cross-sections of each of the two dielectric bars taken perpendicular to the Z axis include:

a first-cross-section having a first-rectangular shape including a width that is less than the minimum width; and a second-cross-section having a second-rectangular shape including a width that is less than the minimum width.

9. An inner-conductive tube for use in a coaxial polarizer, comprising:

a first shallow-cavity on an outer surface of the inner-conductive tube, wherein the first shallow-cavity has a first-full-planar area, the first-full-planar area having a first-cavity length parallel to a Z axis and having at least one first-cavity width perpendicular to the Z axis and perpendicular to a first radial direction of the inner-conductive tube, the at least one first-cavity width including a first-minimum width; and a second shallow-cavity on the outer surface of the inner-conductive tube, the second shallow-cavity opposing the first shallow-cavity and having a second-full-planar area, the second-full-planar area having a second-cavity length parallel to the Z axis and having at least one second-cavity width perpendicular to the Z axis and perpendicular to a second radial direction of the inner-conductive tube, the at least one second-cavity width including a second-minimum width.

10. The inner-conductive tube of claim 9, further comprising:

a metal ring encircling the outer surface of the inner-conductive tube, the ring being offset, along the Z axis, from the first shallow-cavity and the second shallow-cavity.

11. The inner-conductive tube of claim 9, wherein the first-cavity length equals the second-cavity length and the at least one first-cavity width equals the at least one second-cavity width.

12. The inner-conductive tube of claim 9, wherein the first-full-planar area of the first shallow-cavity comprises:

a first planar area in a first section having a first-cavity width equal to the first-minimum width, and first-cavity width being perpendicular to the Z axis and perpendicular to the first radial direction of the inner-conductive tube;

a second planar area in a second section adjoined to the first section and having a second-cavity width perpendicular to the Z axis and perpendicular to the first radial direction of the inner-conductive tube; and a third planar area in a third section adjoined to the first section having a third-cavity width perpendicular to the Z axis and perpendicular to the first radial direction of the inner-conductive tube, wherein the second section and the third section are offset from each other by a length of the first section, and wherein the second-cavity width and third-cavity width are larger than the first-minimum width.

13. The inner-conductive tube of claim 12, wherein the second-full-planar area of the second shallow-cavity comprises:

a fourth planar area in a fourth section having the fourth-cavity width equal to the second-minimum width, the fourth-cavity width being perpendicular to the Z axis and perpendicular to the second radial direction of the inner-conductive tube;

a fifth planar area in a fifth section adjoined to the fourth section having a fifth-cavity width perpendicular to the Z axis and perpendicular to the second radial direction of the inner-conductive tube; and a sixth planar area in a sixth section adjoined to the fourth section having a sixth cavity width perpendicular to the Z axis, wherein the fifth section and the sixth section are offset from each other by a length of the fourth section, and wherein the fifth-cavity width and sixth-cavity width are larger than the second-minimum width.

14. The inner-conductive tube of claim 9, wherein at least one of the first shallow-cavity and the second shallow-cavity comprises:

a first-section-planar area that spans a first plane, the first-section-planar area having the first-cavity width equal to the first-minimum width, the first-cavity width being perpendicular to the Z axis and perpendicular to the first radial direction of the inner-conductive tube;

a second-section-planar area that spans a second plane adjoining the first plane, the second-section-planar area having a third-cavity width perpendicular to the Z axis and perpendicular to the first radial direction of the inner-conductive tube, the second plane being offset in a negative radial direction from the first plane; and a third-section-planar area that spans a third plane adjoining the first plane, the third-section-planar area having a fourth-cavity width perpendicular to the Z axis and perpendicular to the first radial direction of the inner-conductive tube, the third plane being offset in the negative radial direction from the first plane, wherein the second-section-planar area and the third-section-planar area are offset from each other by a length of the first-section-planar area, and wherein the third-cavity width and the fourth-cavity width are larger than the first-minimum width.

15. The inner-conductive tube of claim 9, wherein at least one of the first-full-planar area of the first shallow-cavity and the second-full-planar area of the second shallow-cavity is rectangular in shape.

16. A method of making an inner-conductive tube, the method comprising:

machining a first shallow-cavity having at least one first-planar area on an outer-curved surface of a cylindrical piece aligned to an axial direction; and machining a second shallow-cavity having at least one second-planar area on an outer-curved surface of the cylindrical piece, wherein the first-planar area opposes the second planar area.

17. The method of claim 16, wherein machining the first shallow-cavity having the at least one first-planar area on the outer surface of the cylindrical piece comprises:

machining a first-planar area in a first section of the first shallow-cavity, the first-planar area having a length parallel to the axial direction and a first width perpendicular to the axial direction;

machining a second-planar area in a second section of the first shallow-cavity, the second-planar area having a second width perpendicular to the axial direction and the second-planar area adjoining the first-planar area at a first end of first-planar area; and machining a third-planar area in a third section of the first shallow-cavity, the third-planar area having a third width perpendicular to the axial direction and the third-planar area adjoining the first-planar area at a second end of first-planar area.

18. The method of claim 16, wherein machining the first shallow-cavity having the at least one first-planar area on the outer surface of the cylindrical piece comprises:

machining a first-planar area in a first section of the first shallow-cavity, the first-planar area having a length parallel to the axial direction and a first width perpendicular to the axial direction;

machining a second-planar area in a second section of the first shallow-cavity, the second-planar area having a second width perpendicular to the axial direction, wherein second-planar area is offset in a negative radial direction from the first-planar area; and machining a third-planar area in a third section of the first shallow-cavity, the third-planar area having a third width perpendicular to the axial direction, wherein the third planar area is offset in the negative radial direction from the first-planar area.

19. The method of claim 16, further comprising:

positioning a metal ring over the outer surface of the cylindrical piece, wherein the metal ring is offset, along the Z axis, from the first shallow-cavity and the second shallow-cavity.

20. The method of claim 16, further comprising:

attaching a flat surface of a first dielectric bar to the at least one planar area of the first shallow-cavity; and attaching a flat surface of a second dielectric bar to the at least one planar area of the second shallow-cavity.

21. A coaxial polarizer comprising:

an outer-conductive tube having an inner surface;

an inner-conductive tube positioned within the outer-conductive tube and axially aligned with the outer-conductive tube, the inner-conductive tube having an outer surface; and a first dielectric bar having a first surface and an opposing second surface, the first surface attached to a first portion of the inner-conductive tube, wherein the second surface is separated from the inner surface of the outer conductive tube by a first gap, wherein a third surface of the first dielectric bar is perpendicular to a first plane that is tangent to the outer surface of the inner-conductive tube at a line of contact between the third surface of the first dielectric bar and the first portion of the inner-conductive tube, and wherein a fourth surface of the first dielectric bar is perpendicular to a second plane that is tangent to the outer surface of the inner-conductive tube at a line of contact between the fourth surface of the first dielectric bar and the first portion of the inner-conductive tube; and a second dielectric bar having a fifth surface and an opposing sixth surface, the fifth surface attached to a second portion of the inner-conductive tube, the second portion opposing the first portion, wherein the sixth surface is separated from the inner surface of the outer conductive tube by a second gap, wherein a seventh surface of the second dielectric bar is perpendicular to a third plane that is tangent to the outer surface of the inner-conductive tube at a line of contact between the seventh surface of the second dielectric bar and the second portion of the inner-conductive tube, and wherein an eighth surface of the second dielectric bar is perpendicular to a fourth plane that is tangent to the outer surface of the inner-conductive tube at a line of contact between the eighth surface of the second dielectric bar and the second portion of the inner-conductive tube.

22. The coaxial polarizer of claim 21, wherein the inner-conductive tube has an axial dimension parallel to a Z axis and the outer surface has a radius of curvature, wherein the first surface of the first dielectric bar is a first curved surface, and the second surface of the first dielectric bar is a second curved surface opposing a first portion of the first curved surface, wherein the third surface of the first dielectric bar is parallel to a first radial direction oriented by a first angle, and wherein the fourth surface of the first dielectric bar is parallel to a second radial direction oriented by a second angle.

23. The coaxial polarizer of claim 22, wherein the second curved surface of the first dielectric bar opposes the first portion of the first curved surface, the first dielectric bar further comprising a third curved surface opposing a second portion of the first curved surface, wherein the second curved surface opposing the first portion of the first curved surface is offset radially from the third curved surface opposing the second portion of the first curved surface.

24. The coaxial polarizer of claim 22, wherein the fifth surface of the second dielectric bar is a fifth curved surface, and the sixth surface of the second dielectric bar is a sixth curved surface opposing a first portion of the fifth curved surface, wherein the seventh surface of the second dielectric bar is parallel to a third radial direction oriented by a third angle, and wherein the eighth surface of the second dielectric bar is parallel to a fourth radial direction oriented by a fourth angle.

25. The coaxial polarizer of claim 24, wherein the sixth curved surface of the second dielectric bar opposes the first portion of the fifth curved surface, the second dielectric bar further comprising a seventh curved surface opposing a second portion of the fifth curved surface, wherein the sixth curved surface opposing the first portion of the fifth curved surface is offset radially from the seventh curved surface opposing the second portion of the fifth curved surface.

26. A coaxial polarizer comprising:

an outer-conductive tube having an inner surface;

an inner-conductive tube positioned within the outer-conductive tube and axially aligned with the outer-conductive tube, the inner-conductive tube having an outer surface; and a first dielectric bar having a first surface and an opposing second surface, the first surface attached to a first portion of the inner-conductive tube, wherein the second surface is separated from the inner surface of the outer conductive tube by a first gap, wherein a third surface of the first dielectric bar is perpendicular to the outer surface of the inner-conductive tube at a line of contact between the third surface of the first dielectric bar and the first portion of the inner-conductive tube, and wherein a fourth surface of the first dielectric bar is perpendicular to the outer surface of the inner-conductive tube at a line of contact between the fourth surface of the first dielectric bar and the first portion of the inner-conductive tube, wherein the third surface is not parallel to the fourth surface; and a second dielectric bar having a fifth surface and an opposing sixth surface, the fifth surface attached to a second portion of the inner-conductive tube, the second portion opposing the first portion, wherein the sixth surface is separated from the inner surface of the outer conductive tube by a second gap, wherein a seventh surface of the second dielectric bar is perpendicular to the outer surface of the inner-conductive tube at a line of contact between the seventh surface of the second dielectric bar and the second portion of the inner-conductive tube, and wherein an eighth surface of the second dielectric bar is perpendicular to the outer surface of the inner-conductive tube at a line of contact between the eighth surface of the second dielectric bar and the second portion of the inner-conductive tube, wherein the seventh surface is not parallel to the eighth surface.

* * * * *